US008940682B2

(12) United States Patent
Smith et al.

(10) Patent No.: US 8,940,682 B2
(45) Date of Patent: Jan. 27, 2015

(54) PEROXYGEN CATALYST-CONTAINING FABRIC AND USE FOR IN SITU GENERATION OF ALKALINITY

(75) Inventors: Kim R. Smith, Woodbury, MN (US); Sherri L. Tischler, Inver Grove Heights, MN (US); Thomas R. Mohs, Eagan, MN (US); Erik C. Olson, Savage, MN (US); Keith E. Olson, Apple Valley, MN (US)

(73) Assignee: Ecolab USA Inc., Saint Paul, MN (US)

( * ) Notice: Subject to any disclaimer, the term of this patent is extended or adjusted under 35 U.S.C. 154(b) by 277 days.

(21) Appl. No.: 12/780,503

(22) Filed: May 14, 2010

(65) Prior Publication Data

US 2010/0292126 A1 Nov. 18, 2010

Related U.S. Application Data

(60) Provisional application No. 61/178,339, filed on May 14, 2009.

(51) Int. Cl.

| | |
|---|---|
| ***C11D 3/02*** | (2006.01) |
| ***B08B 3/14*** | (2006.01) |
| ***C11D 3/39*** | (2006.01) |
| ***C11D 3/00*** | (2006.01) |

(52) U.S. Cl.

CPC ..... *C11D 3/3932* (2013.01); *C11D 3/0047* (2013.01); *C11D 3/3947* (2013.01)

USPC ..... 510/508; 134/42

(58) Field of Classification Search

USPC ..... 510/508; 134/42

See application file for complete search history.

(56) References Cited

U.S. PATENT DOCUMENTS

| | | | | |
|---|---|---|---|---|
| 3,423,330 | A | 1/1969 | Start | |
| 3,488,962 | A | 1/1970 | McCormick | |
| 4,536,183 | A | 8/1985 | Namnath | |
| 4,601,845 | A | 7/1986 | Namnath | |
| 4,623,357 | A | 11/1986 | Urban | |
| 5,244,594 | A * | 9/1993 | Favre et al. | 510/310 |
| 5,468,448 | A | 11/1995 | Nicolson et al. | |
| 5,626,717 | A | 5/1997 | Yin et al. | |
| 5,653,910 | A | 8/1997 | Kerschner et al. | |
| 5,703,030 | A * | 12/1997 | Perkins et al. | 510/311 |
| 5,711,146 | A | 1/1998 | Armstrong et al. | |
| 5,720,897 | A | 2/1998 | Drago et al. | |
| 5,792,090 | A | 8/1998 | Ladin | |

(Continued)

FOREIGN PATENT DOCUMENTS

| | | |
|---|---|---|
| EP | 0549271 A1 | 6/1993 |
| EP | 2103735 A1 | 9/2009 |

(Continued)

OTHER PUBLICATIONS

International Search Report for PCT/IB2010/052158, mailed Jan. 11, 2011.

(Continued)

*Primary Examiner* — Ling Choi
*Assistant Examiner* — Thuy-Al Nguyen
(74) *Attorney, Agent, or Firm* — McKee, Voorhees & Sease

(57) ABSTRACT

The invention discloses compositions and methods for generating alkalinity in situ. The compositions and methods relate to the use of a fabric source containing a decomposition agent to catalyze the decomposition of a dilute peroxygen source. The methods provide a highly alkaline cleaning composition produced at a desired time and place of use. Methods of cleaning are also disclosed.

27 Claims, 14 Drawing Sheets

(56) References Cited

U.S. PATENT DOCUMENTS

| | | | | |
|---|---|---|---|---|
| 5,942,152 | A | 8/1999 | Tafesh et al. | |
| 6,004,510 | A | 12/1999 | Gilbert et al. | |
| 6,306,808 | B1 | 10/2001 | Hazenkamp et al. | |
| 6,415,010 | B2 | 7/2002 | Kim et al. | |
| 6,834,494 | B2 | 12/2004 | Lohner et al. | |
| 6,875,734 | B2 | 4/2005 | Reinhardt et al. | |
| 6,887,821 | B2 | 5/2005 | Mays et al. | |
| 6,939,630 | B2 | 9/2005 | Sotomura et al. | |
| 6,991,772 | B1 | 1/2006 | Rusek | |
| 7,083,690 | B2 | 8/2006 | Dobbins et al. | |
| 7,507,494 | B2 | 3/2009 | Burlatsky et al. | |
| 2004/0197252 | A1 | 10/2004 | Parrish | |
| 2005/0019229 | A1 | 1/2005 | Parrish | |
| 2005/0095355 | A1 | 5/2005 | Leistra et al. | |
| 2005/0124519 | A1 * | 6/2005 | Sherry et al. | 510/238 |
| 2005/0215459 | A1 * | 9/2005 | Policicchio et al. | 510/438 |
| 2005/0249679 | A1 | 11/2005 | Cameron et al. | |
| 2006/0154841 | A1 | 7/2006 | Jakob et al. | |
| 2007/0114121 | A1 | 5/2007 | Kinlen et al. | |
| 2007/0213209 | A1 | 9/2007 | Siddiqui et al. | |
| 2010/0035060 | A1 | 2/2010 | Leininger et al. | |
| 2010/0048445 | A1 | 2/2010 | Gerusz et al. | |

FOREIGN PATENT DOCUMENTS

| | | | |
|---|---|---|---|
| GB | 945370 | | 12/1963 |
| JP | 2001242427 | A | 9/2001 |
| JP | 2005187743 | A | 7/2005 |
| WO | WO 00/50552 | A1 | 8/2000 |

OTHER PUBLICATIONS

Bagg, J., "The Catalytic Decomposition of Hydrogen Peroxide Solutions by Single Crystals of Silver", Division of Tribophysics, University of Melbourne, Manuscript received Aug. 8, 1961, pp. 201-210.

Baumgartner, H. J. et al., "Decomposition of Concentrated Hydrogen Peroxide on Silver I. Low Temperature Reaction and Kinetics", Journal of Catalysis 2, Jun. 5, 1963, pp. 405-414.

Baumgartner, H. J. et al., "Decomposition of Concentrated Hydrogen Peroxide on Silver II. High Temperature Decomposition", Journal of Catalysis 2, Jun. 5, 1963, pp. 415-420.

Goszner, K. et al., "On the Catalytic Activity of Silver I. Activity, Poisoning, and Regeneration During the Decomposition of Hydrogen Peroxide", Journal of Catalysis 25, (1972) pp. 245-253.

Hage, Ronald et al., "Bleach and oxidation catalysis by manganese-1,4,7-triazacylononane complexes and hydrogen peroxide", Journal of Molecular Catalysis A: Chemical 251, (2006), pp. 150-158.

Hasan, Muhammad A. et al., "Promotion of the hydrogen peroxide decomposition activity of manganese oxide catalysts", Applied Catalysis A: General 181, (1999), pp. 171-179.

Lazarov, D. et al., "Investigations on the Influence of Halogen and Sulfate Ions upon the Catalytic Activity of Silver", Journal of Catalysis 3, (1964) pp. 201-206.

Merkulova, N. D. et al., "Reactions of Hydrogen Peroxide on a Silver Electrode in Alkaline Solution", Electrochimica Acta, 1973, vol. 18, pp. 169-174.

Pirault-Roy, Laurence et al., "Hydrogen Peroxide Decomposition on Various Supported Catalysts Effect of Stabilizers", Journal of Propulsion and Power, vol. 18, No. 6, Nov.-Dec. 2002, pp. 1235-1241.

Rusek, John J., "New Decomposition Catalysts and Characterization Techniques for Rocket-Grade Hydrogen Peroxide", Journal of Propulsion and Power, vol. 12, No. 3, May-Jun. 1996, pp. 574-579.

* cited by examiner

PEROXYGEN CATALYST-CONTAINING FABRIC AND USE FOR IN SITU GENERATION OF ALKALINITY

FIELD OF THE INVENTION

The present invention relates to compositions and methods for generating alkalinity in situ. In particular, the compositions and methods relate to the decomposition of a peroxygen source using a fabric source comprising a decomposition agent for use in cleaning.

CROSS-REFERENCE TO RELATED APPLICATIONS

This application is a nonprovisional application of U.S. Provisional Application No. 61/178,339, filed May 14, 2009, which is herein incorporated by reference in its entirety.

BACKGROUND OF THE INVENTION

Alkaline cleaning compositions are known to be effective in various applications. For example, alkaline cleaners are effective as grill and oven cleaners, warewash detergents, laundry detergents, laundry presoaks, drain cleaners, hard surface cleaners, surgical instrument cleaners, transportation vehicle cleaning, dishwash presoaks, dishwash detergents, beverage machine cleaners, concrete cleaners, building exterior cleaners, metal cleaners, floor finish strippers, degreasers, burnt-on soil removers. For some applications, cleaning agents having a very high alkalinity are most desirable and provide ideal cleaning. For example, floor stripping compositions for removal of floor finishes require a highly alkaline pH for effective cleaning.

In many applications, these highly alkaline cleaning compositions must be transported, handled and applied by workers. However, such agents can be dangerous and can cause burns to exposed skin, particularly in the concentrated form. As the alkalinity of the compositions increases, the possible risk to workers also increases. Great care must be taken to protect workers who handle concentrated highly alkaline materials. A need therefore exists for cleaning compositions that minimize the risks to workers but perform as alkaline cleaners.

Accordingly, it is an objective of the claimed invention to develop highly alkaline cleaning compositions without the need to transport such compositions.

A further object of the invention are reusable compositions or systems for generating highly alkaline cleaning compositions.

A further object of the invention are methods for generating in situ alkalinity.

A still further object of the invention are systems for generating in situ alkalinity.

BRIEF SUMMARY OF THE INVENTION

In situ generation of alkalinity is provided according to the invention. Embodiments of the invention include compositions, systems and methods for generating a cleaning composition capable of forming alkalinity at the point of use. In some aspects, the composition includes a peroxygen source and a decomposition agent, wherein the decomposition agent catalyzes the decomposition of the peroxygen source to generate a source of alkalinity. In additional aspects of the invention, the decomposition agent facilitates the decomposition of the peroxygen source to create alkalinity at a desired time and point of use of the cleaning composition. In preferred embodiments of the invention the decomposition agents are metals derived from oxides, colloidals, inorganic or organic complexes and/or salts of salt forming species with silver, manganese or vanadium.

The cleaning composition according to the invention may further include a cleaning agent. The decomposition agent, cleaning agent and peroxygen source may each be provided separately according to various embodiments of the invention. In some embodiments, the use solution of the cleaning composition has a pH between about 7 and about 10 prior to peroxygen decomposition. In some aspects, the decomposition agent facilitates or catalyzes the decomposition of the peroxygen source to generate alkalinity to increase the pH of the cleaning composition to greater than about 10, preferably greater than about 12 to provide a highly effective alkaline cleaning composition.

According to the invention, the composition and systems may comprise a support media. According to an embodiment, the decomposition agent may be bound to a fabric, providing a convenient, reusable source of decomposition agent to generate alkalinity. Alternatively, the decomposition agent may be provided in a cartridge, part of a dispenser or other means for generating in situ alkalinity.

An advantage of the invention is the production of highly alkaline cleaning compositions in situ, obviating the need to transport highly alkaline or caustic cleaning compositions, thereby reducing the risk of exposure to workers. In addition, the compositions, systems and methods according to the invention do not require the use of highly concentrated peroxygen sources. Use of the decomposition agent with the dilute peroxygen source increases alkalinity and causes bubbling to provide improved cleaning. The provided cleaning compositions allow the use of concentrates with initially decreased levels of alkalinity for cleaning applications requiring high levels of alkalinity due to the in situ production of alkalinity.

It is a further advantage of the present invention that highly alkaline cleaning compositions are formed in situ, when the cleaning composition is desired to be used. The decomposition agent and the peroxygen source can be brought into contact, generating alkalinity at a desired time and location, such as on a surface in need of treatment. The increased alkalinity can thus be generated in situ at the site of use or at some desired time prior to use. The ability to use cleaning compositions having initially lower alkalinity by generating additional alkalinity at a desired time allows for increased safety for the workers who handle and use the cleaning composition.

DETAILED DESCRIPTION OF THE PREFERRED EMBODIMENT

Figure 1:
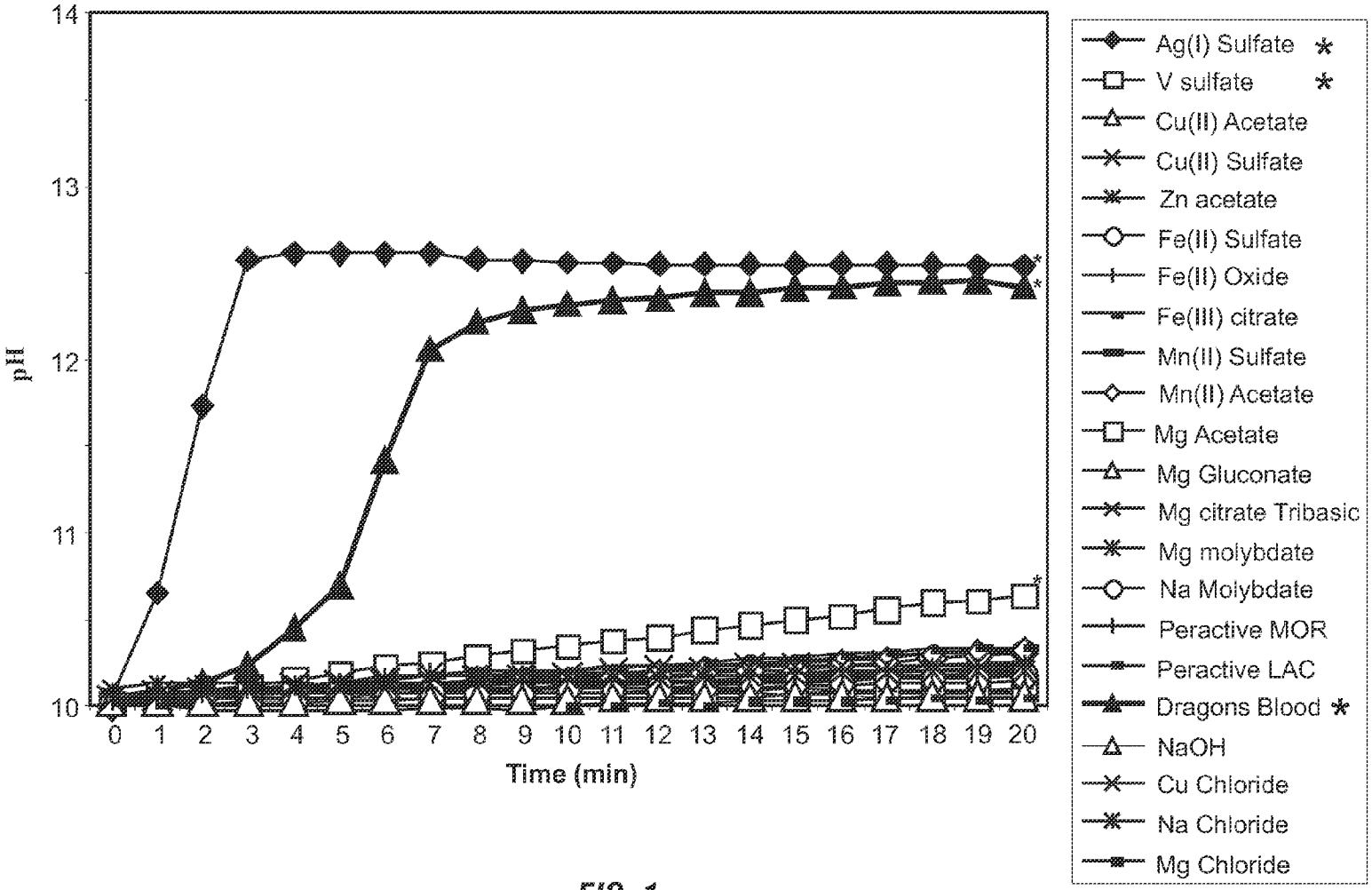
FIG. 1 demonstrates pH over time for various potential decomposition agents.

The embodiments of this invention are not limited to particular embodiments for in situ generation of alkalinity with decomposition agents, which can vary and are understood by skilled artisans. It is further to be understood that all terminology used herein is for the purpose of describing particular embodiments only, and is not intended to be limiting in any manner or scope. For example, as used in this specification and the appended claims, the singular forms "a," "an" and "the" can include plural referents unless the content clearly indicates otherwise. Further, all units, prefixes, and symbols may be denoted in its SI accepted form. Numeric ranges recited within the specification are inclusive of the numbers defining the range and include each integer within the defined range.

Unless defined otherwise, all technical and scientific terms used herein have the same meaning as commonly understood by one of ordinary skill in the art to which embodiments of the invention pertain. Many methods and materials similar, modified, or equivalent to those described herein can be used in the practice of the embodiments of the present invention without undue experimentation, the preferred materials and methods are described herein. In describing and claiming the embodiments of the present invention, the following terminology will be used in accordance with the definitions set out below.

The term "about," as used herein, refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like. The term "about" also encompasses amounts that differ due to different equilibrium conditions for a composition resulting from a particular initial mixture. Whether or not modified by the term "about", the claims include equivalents to the quantities refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like.

The term "decomposition agent," as used herein, refers to a compound, compounds or compositions capable of degrading or decomposing a peroxygen source into a source of alkalinity. The combined effect of decomposition and generation of alkalinity are necessary for a decomposition agent according to the invention. This is distinct from the recognized use of certain transition metals to decompose hydrogen peroxide for improved bleaching activity. This is also distinct from the recognized use of certain transition metals to decompose hydrogen peroxide without the formation of alkalinity.

The term "in situ," as used herein, refers to creation of an element, or in the case of the invention, creation of a hydroxide anions from a peroxygen source either upon formation of a use composition, or upon delivery of the use composition to the treatment surface, or when forming the concentrate composition of the invention.

The term "weight percent," "wt-%," "percent by weight," "% by weight," and variations thereof, as used herein, refer to the concentration of a substance as the weight of that substance divided by the total weight of the composition and multiplied by 100. It is understood that, as used here, "percent," "%," and the like are intended to be synonymous with "weight percent," "wt-%," etc.

According to an embodiment of the invention the alkaline cleaning composition may be used in a variety of applications where highly alkaline pH is preferred, including as a grill and oven cleaner, warewash detergent, laundry detergent, laundry presoak, drain cleaner, hard surface cleaner, medical instrument cleaner, transportation vehicle cleaning, dishwash presoak, dishwash detergent, beverage machine cleaner, concrete cleaner, building exterior cleaner, metal cleaner, floor finish stripper, degreaser, burnt-on soil, or antimicrobial. In some embodiments, the decomposition agent is located in a washing system. The washing system may include a ware washing machine, an automatic dishwashing machine, a vehicle washing system, an instrument washer, a clean-in-place system, a food processing cleaning system, a bottle washer, or a laundry washing machine.

Compositions

An embodiments of the invention provides a cleaning composition capable of forming alkalinity at the point of use. The composition comprises a peroxygen source and a decomposition agent. In some embodiments, the composition also includes a cleaning agent. In still further embodiments, the composition can further include one or more promoters for the decomposition agent. In some embodiments, the cleaning composition and its use solution are substantially free of iron.

Decomposition Agents

According to the invention, the decomposition agent catalyzes the decomposition of the peroxygen source generating alkalinity. The decomposition agent may further facilitate the decomposition of the peroxygen source, preferably a dilute peroxygen source. Still further, the decomposition agent causes bubbling useful for improved cleaning, such as removal of soil from hard surfaces. Production of alkalinity in situ allows for the use of cleaning compositions, such as cleaning concentrates, having decreased levels of alkalinity in applications which require higher levels of alkalinity as the decomposition agent and the peroxygen source can be brought into contact, generating alkalinity at the desired time of use.

The decomposition agent according to the invention may include various substances as well as the use of one or more decomposition agents for a cleaning composition. The decomposition agent according to the invention is not consumed by the reaction with the peroxygen source. Accordingly, it is an embodiment of the invention that the decomposition agent does not need to be replaced and is be reusable in combination with various support media. In some embodiments, the decomposition agent may have activity as a bleach activator in the presence of a bleachable substrate and as a decomposition agent for the increase of alkalinity from the decomposition of a peroxygen source in the absence of a bleachable substrate. In further embodiments, the decomposition agent of the reduced alkalinity cleaning composition is metallic. Examples of decomposition agents include various forms of metallic manganese, silver, and vanadium.

According to preferred embodiments the decomposition agent includes at least once source of manganese. In some embodiments, the manganese source is derived from manganese metal, manganese oxides, colloidal manganese, inorganic or organic complexes of manganese, including manganese sulfate, manganese carbonate, manganese acetate, manganese lactate, manganese nitrate, manganese gluconate, manganese chloride or commercially available as Dragon A350 (also known as Dragon's Blood, available from Rahu Catalystics of Nottingham, U.K.), or any of the salts of salt forming species with manganese.

According to a further preferred embodiment, the decomposition agent includes at least once source of silver. In some embodiments, the silver source is derived from silver metal, silver oxides, silver hydroxide, colloidal silver, inorganic or organic complexes of silver, water-soluble or insoluble silver salts, including silver sulfate, silver carbonate, silver acetate, silver lactate, silver nitrate, silver gluconate, or silver chloride, or any of the salts of or salt forming species with silver. According to a still further embodiment, the decomposition agent includes at least once source of vanadium.

According to the invention, the decomposition agent is substantially free of iron, which may slow down the rate or counteract the activity of the decomposition agent according to the invention. In some embodiments, the decomposition agents may be soluble in water, slightly soluble in water, form a suspension in water or insoluble in water. According to further embodiments, the decomposition agent is provided in its solid, naturally occurring form. For example, the metallic silver decomposition agent according to an embodiment of the invention may be provided as a solid piece of silver. In other embodiments, the decomposition agent can be deposited onto or into a catalyst support matrix.

According to the invention, increasing the concentration of the decomposition agent results in a faster rate of pH increase. In some embodiments of the invention, the decomposition agent has a concentration in a cleaning composition without a support medium from about 0.5 ppm to about 10 wt-%. In some embodiments, the decomposition agents are present at about 1 ppm to about 5 wt-%, or from about 50 ppm to about 2 wt-%. In further embodiments of the invention, the decomposition agent has a concentration in a cleaning composition when present on a support medium from about 1 wt-% to about 100 wt-%. In some embodiments, the decomposition agents are present at about 5 wt-% to about 50 wt-%, and in other embodiments at about 10 wt-% to about 30 wt-%. It is to be understood that all values and ranges between these values and ranges are encompassed by the invention.

According to the invention, the decomposition agent may be incorporated into a detergent composition and the peroxygen source held separate from the detergent. In some embodiments, the decomposition agent may be incorporated into the detergent with the peroxygen source. In other embodiments, both the peroxygen source and the decomposition agent may be held separate from the detergent composition.

Peroxygen Source

According to the invention, the peroxygen source of the cleaning composition is any peroxygen source capable of generating alkalinity and/or bubbles after contacting the decomposition agent according to the present invention. Embodiments of the invention may include one or more peroxygen sources that are degraded or decomposed by the decomposition agent, generating alkalinity and bubbling according to the invention. Exemplary peroxygen sources include percarboxylic compounds. For example, the percarboxylic compound may be peracetic acid, peroctanoic acid, or a perester. In some embodiments, the peroxygen source is hydrogen peroxide and its adducts such as sodium percarbonate and urea peroxide, sodium persulfate, sodium perborate, or the corresponding lithium, potassium, barium, calcium, or magnesium salts. In another embodiment, the peroxygen source is an organic peroxide or hydroperoxide compound. According to a further embodiment, the peroxygen source is hydrogen peroxide prepared in situ using an electrochemical generator.

In some embodiments of the invention, the peroxygen source has a concentration between about 0.01-10% of the cleaning composition. In further embodiments, the peroxygen source is present at a concentration between about 0.5% and 5% of the cleaning composition. In still further embodiments, the peroxygen source is present at a concentration between about 0.1 and 3% of the cleaning composition. It is to be understood that all values and ranges between these values and ranges are encompassed by the methods of the present invention.

When the peroxygen source is contacted with the decomposition agent, the peroxygen source decomposes to generate alkalinity and bubbling. The decomposition agent is not consumed in the reaction, and therefore the decomposition agent can continually catalyze the reaction without immediate need for replacement. It has also been found that increasing the ratio of decomposition agent to peroxygen source allows for the generation of alkalinity using lower concentrations of peroxygen source.

The peroxygen source may be provided as a component of a cleaning agent. Alternatively, the peroxygen source may be provided separately, as an independent raw material source from a cleaning agent. In embodiments in which the peroxygen source is provided separately from a cleaning agent, for example a peroxide peroxygen source may be combined with a cleaning agent at any time before use or at the point of use of the cleaning composition or during use of the cleaning composition.

Cleaning Agents

According to the invention, a cleaning agent may be included in the cleaning composition with the decomposition agent and the peroxygen source. In some embodiments, the peroxygen source is provided in the cleaning composition. In other embodiments, the peroxygen source is provided separately from the cleaning composition. In some embodiments, the decomposition agent is provided in the cleaning agent. In other embodiments, the decomposition agent is provided separately from the cleaning agent. In some embodiments, the decomposition agent and the peroxygen source are both provided separately from the cleaning agent.

The cleaning agent according to the invention is preferably a reduced alkalinity detergent, having a pH between about 7 and about 10. The cleaning agent according to the embodiments of the invention may be either a liquid or a solid. Any cleaning agent which would be useful at an increased alkalinity may be used according to the invention. The cleaning agent according to the invention may include, but is not limited to, one or more of the following components: inorganic additives; alkalinity sources; builders, e.g., chelating/sequestering agents; threshold agents, organic additives; surfactants; rinse aids; sanitizers/antimicrobial agents; defoaming agents; anti-redeposition agents; optical brighteners; dyes; odorants; hardening agents; solubility modifiers; and combinations thereof, as well as a variety of other materials, depending upon the desired characteristics and/or functionality of the cleaning agent for use according to the invention. Any one or more of these optional components of a cleaning agent may alternately, or additionally, be provided separately from a cleaning agent to be included in the final cleaning composition according to the invention.

In some embodiments, the cleaning agent can be incorporated into the composition including the peroxygen source in order to achieve a desired benefit. For example, in some embodiments, a surfactant can be included in the compositions including a peroxygen source. The surfactant can be selected such that when the composition is contacted by a decomposition agent, an alkaline foam results for use in a cleaning application. In further embodiments, the cleaning agent can be incorporated into the decomposition agent. In some embodiments, the cleaning agent, peroxygen source, and decomposition agent can be combined. In some embodiments, at least one of the peroxygen source or decomposition agent are encapsulated.

The cleaning agents for use with the present invention can include effective amounts of one or more initiating alkalinity sources to, for example, initiate or accelerate the decomposition of the peroxygen source or to enhance cleaning of a substrate and improve soil removal performance of the composition. In some embodiments, a metal carbonate such as sodium or potassium carbonate, bicarbonate, sesquicarbonate, mixtures thereof and the like can be used. Examples of useful alkaline sources include a metal silicate such as sodium or potassium silicate (for example, with a $M_2O:SiO_2$ ratio of about 1:2.4 to about 5:1, M representing an alkali metal) or metasilicate; a metal borate such as sodium or potassium borate, and the like; ethanolamines and amines; and other like alkaline sources. Exemplary alkalinity sources suitable for use with the methods of the present invention include, but are not limited to, sodium, potassium, and lithium carbonate and bicarbonate salts and combinations thereof. In some embodiments, the compositions can include up to about 80 wt-%; about 1-70 wt-%; or about 5-60 wt-% of an additional alkalinity source.

In some embodiments of the invention, the cleaning agents for use with the present invention include a peroxy-containing cleaning agent. In some embodiments, the peroxy-containing cleaning agents are free or substantially free of a source of alkalinity. When a peroxy-containing cleaning agent that is free or substantially free of a source of alkalinity is used, the detergent can have a pH of about 7 to about 10 in a use solution, in the absence of the decomposition agent. Once contacted with a decomposition agent the pH of the use solution increases to between about 10 and about 13. Thus, using the methods of the present invention, a highly alkaline cleaning composition can be prepared that is substantially free of a source of alkalinity prior to contacting the peroxygen source with a decomposition agent.

Further embodiments of the invention include the use of a variety of surfactants for use as the cleaning agents, including anionic, nonionic, cationic, and zwitterionic surfactants, which are commercially available from a number of sources. Suitable surfactants according to the invention include nonionic surfactants. Suitable nonionic surfactants include, for example, low foaming non-ionic surfactants. For a discussion of surfactants, see Kirk-Othmer, Encyclopedia of Chemical Technology, Third Edition, 8:900-912.

Suitable nonionic surfactants for use in the present invention include those having a polyalkylene oxide polymer as a portion of the surfactant molecule. Such nonionic surfactants include, for example, chlorine-, benzyl-, methyl-, ethyl-, propyl-, butyl- and other like alkyl-capped polyethylene and/or polypropylene glycol ethers of fatty alcohols; polyalkylene oxide free nonionics such as alkyl polyglycosides; sorbitan and sucrose esters and their ethoxylates; alkoxylated ethylene diamine; carboxylic acid esters such as glycerol esters, polyoxyethylene esters, ethoxylated and glycol esters of fatty acids, and the like; carboxylic amides such as diethanolamine condensates, monoalkanolamine condensates, polyoxyethylene fatty acid amides, and the like; and ethoxylated amines and ether amines commercially available from Tomah Corporation and other like nonionic compounds. Silicone surfactants such as the ABIL B8852 (Goldschmidt) can also be used.

Additional suitable nonionic surfactants having a polyalkylene oxide polymer portion include nonionic surfactants of C6-C24 alcohol ethoxylates (e.g., C6-C14 alcohol ethoxylates) having 1 to about 20 ethylene oxide groups (e.g., about 9 to about 20 ethylene oxide groups); C6-C24 alkylphenol ethoxylates (e.g., C8-C10 alkylphenol ethoxylates) having 1 to about 100 ethylene oxide groups (e.g., about 12 to about 20 ethylene oxide groups); C6-C24 alkylpolyglycosides (e.g., C6-C20 alkylpolyglycosides) having 1 to about 20 glycoside groups (e.g., about 9 to about 20 glycoside groups); C6-C24 fatty acid ester ethoxylates, propoxylates or glycerides; and C4-C24 mono- or dialkanolamides. Specific alcohol alkoxylates suitable according to the invention include alcohol ethoxylate propoxylates, alcohol propoxylates, alcohol propoxylate ethoxylate propoxylates, alcohol ethoxylate butoxylates, and the like; nonylphenol ethoxylate, polyoxyethylene glycol ethers and the like; and polyalkylene oxide block copolymers including an ethylene oxide/propylene oxide block copolymer such as those commercially available under the trademark PLURONIC™ (BASF-Wyandotte), and the like.

In some embodiments of the invention, a suitable nonionic surfactant for use in the cleaning composition of the present invention includes low foaming nonionic surfactants. Examples of suitable low foaming nonionic surfactants include secondary ethoxylates, such as those sold under the trade name TERGITOL™, such as TERGITOL™ 15-S-7 (Union Carbide), Tergitol 15-S-3, Tergitol 15-S-9 and the like. Other suitable classes of low foaming nonionic surfactant include alkyl or benzyl-capped polyoxyalkylene derivatives and polyoxyethylene/polyoxypropylene copolymers.

According to further embodiments of the invention, useful nonionic surfactants for use as a defoamer includes nonylphenol having an average of 12 moles of ethylene oxide condensed thereon, it being end capped with a hydrophobic portion comprising an average of 30 moles of propylene oxide. Silicon-containing defoamers are also well-known and can be employed in the compositions of the present invention.

According to still further embodiments of the invention, suitable amphoteric surfactants include amine oxide compounds having the formula:

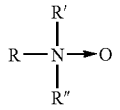

where R, R', R", and R'" are each a C1-C24 alkyl, aryl or aralkyl group that can optionally contain one or more P, O, S or N heteroatoms. A further class of suitable amphoteric surfactants includes betaine compounds having the formula:

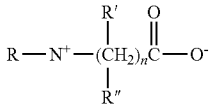

where R, R', R" and R'" are each a C1-C24 alkyl, aryl or aralkyl group that can optionally contain one or more P, O, S or N heteroatoms, and n is about 1 to about 10. According to the invention, suitable surfactants include food grade surfactants, linear alkylbenzene sulfonic acids and their salts, and ethylene oxide/propylene oxide derivatives sold under the Pluronic™ trade name. Suitable surfactants include those that are compatible as an indirect or direct food additive or substance.

In further embodiments of the invention, anionic surfactants suitable for use in the compositions of the present invention, include, for example, carboxylates such as alkylcarboxylates (carboxylic acid salts) and polyalkoxycarboxylates, alcohol ethoxylate carboxylates, nonylphenol ethoxylate carboxylates, and the like; sulfonates such as alkylsulfonates, alkylbenzenesulfonates, alkylarylsulfonates, sulfonated fatty acid esters, and the like; sulfates such as sulfated alcohols, sulfated alcohol ethoxylates, sulfated alkylphenols, alkylsulfates, sulfosuccinates, alkylether sulfates, and the like; and phosphate esters such as alkylphosphate esters, and the like. Suitable anionics include sodium alkylarylsulfonate, alpha-olefin sulfonate, and fatty alcohol sulfates. Examples of suitable anionic surfactants include sodium dodecylbenzene sulfonic acid, potassium laureth-7 sulfate, and sodium tetradecenyl sulfonate.

According to embodiments of the invention, the cleaning agent can also include a builder. Builders include chelating agents (chelators), sequestering agents (sequestrants), detergent builders, and the like. The builder may act to stabilize the cleaning agent. Examples of builders include, but are not limited to, phosphonates, phosphates, aminocarboxylates and their derivatives, pyrophosphates, polyphosphates, ethylenediamene and ethylenetriamene derivatives, hydroxyacids, and mono-, di-, and tri-carboxylates and their corresponding acids. Other exemplary builders include aluminosilicates, nitroloacetates and their derivatives, and mixtures thereof. Still other exemplary builders include aminocarboxylates, including salts of ethylenediaminetetraacetic acid (EDTA), hydroxyethylenediaminetetraacetic acid (HEDTA), and diethylenetriaminepentaacetic acid. According to the invention, preferred builders are water soluble, biodegradable and free of phosphorus. Particularly preferred builders include aminocarboxylic such as EDTA (including tetra sodium EDTA), PAA (polyacrylic acid) and its salts and copolymers, and carboxylates such as citrates and gluconates.

In some embodiments of the invention, the peroxygen source and/or the cleaning agent have an initial pH of greater than about 7 in the absence of decomposition agent. The composition, systems and methods according to the invention provide for reduced alkalinity compositions (optionally including a reduced alkalinity detergent) that may be safely transported and handled. In some embodiments, the initial pH of the peroxygen source and/or the cleaning agent is greater than about 8. In further embodiments, the initial pH of the peroxygen source and/or the cleaning agent is between about 8 and about 10. In still further embodiments, the initial pH of the peroxygen source and/or the cleaning agent is less than about 11 or less than about 12.

Without intending to be bound to a theory, the peroxide decomposition by the decomposition agent forms hydroxide anions, giving an increase in use solution alkalinity. The increased use solution alkalinity is further accompanied by bubbling during the decomposition. An initial pH of at least about 7 is necessary to initiate the reaction between the decomposition agent and the peroxygen source according to the invention. For example, a composition including hydrogen peroxide at a pH between about 7 and 8 demonstrates a pH increase of approximately 2.5 pH units when contacted with a decomposition agent according to the present invention. However, a composition including hydrogen peroxide at a pH of about 5 does not yield a corresponding increase in pH. Therefore, according to the preferred embodiments of the invention, the initial pH of a composition including a peroxygen source and/or the cleaning agent for use in the present invention is about 7, about 8, about 9 or about 10.

Upon contact between the decomposition agent and the peroxygen source and/or cleaning agent, alkalinity and bubbles are generated, thereby increasing the alkalinity of the cleaning composition. In some embodiments, the alkalinity of the cleaning composition is increased by a pH of about 1 as compared to the initial pH. In further embodiments, the alkalinity of the cleaning composition is increased by a pH of greater than 1 as compared to the initial pH. In further preferred embodiments, the alkalinity is increased by a pH of about 2 or more. In some embodiments, the pH of the cleaning composition is increased to greater than about 10. In further preferred embodiments, the pH of the cleaning composition is increased to between about 10 and about 13. In some embodiments, the initial pH of the cleaning composition is between about 8 and 10, and the final pH is between about 10 and about 13.

Promoters

According to the various embodiments of the invention, the cleaning composition may further include one or more promoters for the decomposition agent. The optional promoter may be present as a component of a cleaning agent, for example, or may be separately added to the cleaning composition or incorporated into the catalyst or peroxygen component. Decomposition promoters according to the invention function to increase the rate (i.e., decrease the induction period) at which the decomposition agent catalyzes the decomposition of the peroxygen source in order to generate alkalinity.

Decomposition promoters suitable for use with the present invention include, but are not limited to, a magnesium ion source, a copper ion source, a zinc ion source, and mixtures thereof. In some embodiments of the invention, the magnesium ion source includes magnesium oxide, magnesium hydroxide, magnesium sulfate, magnesium chloride, and mixtures thereof. In further embodiments of the invention, the copper ion source can include, but is not limited to, copper oxide, copper hydroxide, copper acetate, copper carbonate, copper sulfate, copper chloride, and mixtures thereof. In still further embodiments of the invention, zinc ion sources can include, but are not limited to, zinc oxide, zinc hydroxide, zinc sulfate, zinc chloride, zinc acetate, zinc carbonate and mixtures thereof. According to the invention, the cleaning composition and its use solution are substantially free of iron, which may counteract or slow down the activity of the decomposition agent and/or any decomposition promoter.

Systems for In Situ Generation of Alkalinity

In addition to the embodiments of the invention providing a cleaning composition, the present invention provides for systems for generating in situ alkalinity. The systems for generating alkalinity from a cleaning composition at a desired point of use includes a peroxygen source and a decomposition agent according to invention as described. In some embodiments, the system may further include cleaning agents, decomposition promoters and/or support medium as further described herein. According to the invention, the system for in situ generation of alkalinity brings the decomposition agent and the peroxygen source into contact at the desired time for generating alkalinity.

The system according to the invention may include a support medium for the decomposition agent to facilitate the decomposition of the peroxygen source to generate alkalinity at a point of use of the cleaning composition. In some embodiments, the decomposition agent may be bound to, adhered to or deposited on an inert support medium. The support medium according to the invention may be an inert support bed having low water solubility. In some embodiments, the support bed is a source of captive, water insoluble alkalinity. For example, the support medium may include magnesium oxide, magnesium hydroxide, zinc oxide, titanium oxide, aluminum oxide, silicon oxide, alumino-silicate, ceramic, carbon, or polymeric material. The decomposition agent according to the invention may be adhered to the support medium by any means known in the art. For example, the decomposition agent may be adhered to the support medium by physical absorption or by ionic exchange.

According to further embodiments of the invention, any matrix, i.e., substrate, which is compatible with the selected decomposition agent can be used. For example, the matrix can include, but is not limited to, a fabric, a pad, a sponge, an inorganic particle, a foam, and combinations thereof.

In some preferred embodiments, the decomposition agent is bound to or adhered to a fabric. Examples of fabric which may be used include sponges, non woven materials, woven materials, cotton or other natural sources, polyester, polyamide, polyolefin, extruded films and laminates. The decomposition agent according to the invention may be adhered to the fabric by any means known in the art. Examples of commercially available material that may be used in embodiments of the invention to provide a decomposition agent bound to or adhered to a fabric include V.A.C. GranuFoam Silver® Dressing (available from Kinetic Concepts, Inc., Kidlington, United Kingdom), MediSponge® foam featuring Microbisan™ controlled-release silver ion technology (available from Lendell Manufacturing Inc., St. Charles, Mich.) and various metalized materials available from Shieldex Trading, Inc. (Palymyra, N.Y.).

Decomposition agents can be deposited onto and/or into the support matrix in a variety of ways as known by one skilled in the art. For example, the decomposition agent may be adhered to the support medium by physical absorption or by ionic exchange. Further examples of decomposition agents used with fabrics, include the decomposition agent impregnated into the matrix, e.g., a fabric or foam. In other embodiments, the decomposition agent can be extruded or co-extruded (with other polymers) into fibers and/or foams. For example, U.S. Pat. Nos. 6,841,244 and 6,723,428 disclose methods for extruding or co-extruding silver into fibers, and U.S. Pat. No. 7,118,761 discloses methods for extruding or co-extruding silver into a foam matrix. Each of these patents is hereby expressly incorporated by reference herein.

In further embodiments of the invention, the decomposition agent can be incorporated into the support matrix, such as a fabric, by being coated onto the matrix. For example, U.S. Pat. Nos. 7,385,101 and 5,180,585 disclose methods for coating a silver catalyst onto a fiber matrix. Each of these patents is hereby expressly incorporated by reference herein. Decomposition agents can also be electroplated on to matrices or they can be electroless plated on to matrices, such as fibers and fabrics. Still further, decomposition agents can further be woven or knitted into a support matrix, such as a fabric.

Any fabric or combination of fabrics suitable for use with the decomposition agents according to the present invention can be used. For example, the fabric can include, but is not limited to, a woven fabric, a nonwoven fabric, a knitted fabric, a microfiber and any combination thereof. The use of a fabric support matrix permits use of the cleaning composition according to the invention in a variety of applications. For example, an embodiment of the invention includes the use of a metallic decomposition agent on a fabric that is placed over a soil in need of removal. A peroxygen source is added to the fabric and left to treat the soiled surface, requiring only water to be washed over the fabric to remove the caustic and allow save removal of the metallic fabric. This embodiment of the invention allows a soil to be treated with highly alkaline cleaning composition without requiring personnel to contact the caustic composition.

According to further embodiments of the invention, a fabric support matrix including a decomposition agent can be used as a sleeve inserted into a dispensing device, e.g., a bottle, or dispense tube. In other embodiments, a microfiber support matrix including a decomposition agent can be used as a floor cleaner and/or floor finish stripper. In still further embodiments, a support matrix containing a decomposition agent can be placed inside a washing machine, e.g., a laundry or warewash machine. Still further embodiments of the invention with a support matrix facilitate use of a composition and system that can be permanently affixed or semi-permanently affixed to the inside of the washing machine. The support matrix could also be placed in the washing machine prior to each wash, and removed with each wash.

According to further embodiments of the invention, the support matrix can include a pad. The pad can include an abrasive pad, a non-abrasive pad and combinations thereof. Pads suitable for use with the compositions, systems and methods of the present invention can be those used in a variety of cleaning applications, for example, grill cleaning pads. In additional embodiments, the support matrix comprises a material or fabric in the form of a pouch. For example, the material of the pouch may include the decomposition agent, and a peroxygen source may be located within the pouch. For example, a percarbonate, such as a powdered percarbonate, may be contained within the pouch. In other embodiments, the pouch may contain the decomposition agent and/or the peroxygen source within it. For example, the pouch may contain fibers which include the decomposition agent, such as loose fibers of silver or manganese.

In some embodiments of the invention, the decomposition agent may be caused to react with the peroxygen source by passing water, a cleaning agent, or other solution, over or through the pouch. For example, the pouch may be used as a coffee pot cleaner, with the pouch being flushed with water and generating alkalinity. In other embodiments, the pouch may be used within a washing chamber of any sort of automatic or manual washing system, such as laundry, ware washing and instrument care machines. In still other embodiments, the pouch may be used by placing it into a reservoir of water, cleaning agent, or other solution, such as a bucket, spray bottle, or other cleaning composition dispenser. According to the invention, the pouch may be handled safely prior to the activation of the decomposition agent and the peroxygen, such as while placing the pouch into the cleaning system or other location of use. The pouch may also be handled safely after use, once the peroxygen source has been depleted, such as while removing the used pouch from the cleaning system or other location of use.

Additional suitable matrices according to the invention include particles that have been loaded with the decomposition agent. Exemplary particles include, but are not limited to, carbon, ion exchange resin, silicates, sand, aluminum oxide, metal oxides, and/or combinations thereof. Metal oxides suitable for use in the methods of the present invention include zinc oxide, magnesium oxide, titanium oxide, and combinations thereof.

In additional embodiments, the decomposition agent is provided in a cartridge of a column. The cartridge includes one or more inlets and one or more outlets and contains the decomposition agent. The decomposition agent may be bound to a support medium or loose within the cartridge. In some embodiments, the cartridge contains fibers which include the decomposition agent, such as loose fibers of silver. In some embodiments, the cartridge includes one or more filters to contain the decomposition agent and/or support medium within the cartridge. For example, there may be a filter between the inlet and the decomposition agent and/or between the decomposition agent and the outlet. The cartridge may be portable and/or removable. Alternatively, the pouch described above may function like a cartridge, with water, peroxide, or other solution passing through the pouch.

A peroxygen source alone, such as in an aqueous solution, may be supplied to the cartridge to form a cleaning composition. Alternatively, the peroxygen source may be combined with a cleaning agent prior to passing through the cartridge. In some embodiments, the peroxygen source may be combined with the decomposition agent before contacting them with a cleaning agent. In some embodiments, the cartridge may be connected to a dispenser containing a peroxygen source, such that a cleaning agent and the peroxygen source each are separately supplied to the cartridge such that they combine within the cartridge. The cleaning agent and/or peroxygen source may be provided to the cartridge through a bottle or a hose, for example. The cartridge may be provided as a direct add-on to a washing device, such as a dishwasher or a cleaning composition dispenser or combination cleaning apparatus/cleaning composition dispenser.

In additional embodiments, the system includes an attachment. For example, in some embodiments, the attachment is included as part of a dispensing system. Suitable dispensing systems include bottles, e.g., hand held spray bottles. Other dispensing systems include spray-type dispensers such as those disclosed in U.S. Pat. Nos. 4,826,661, 4,690,305, 4,687,121, 4,426,362 and in U.S. Pat. Nos. RE 32,763 and 32,818, the disclosures of which are incorporated by reference herein. For example, a liquid solution including a peroxygen source is sprayed upon an exposed surface of the attachment. The resulting alkaline solution can then be dispensed out of the dispenser to a storage reservoir or directly to a point of use.

In other embodiments, systems of the present invention include an attachment that includes a porous member attached to the distal end of a dispense tube. For example, the attachment can include a decomposition agent impregnated in a fabric support matrix. The fabric support matrix can be provided over the distal end (outflow) of a dispense tube. A peroxygen source is dispensed through the attachment at the distal end of the dispense tube, and an alkalinity source is generated. This alkalinity source can then be used to clean an article, either alone, or in combination with another source of alkalinity and/or a detergent composition.

In additional embodiments, the systems of the present invention include an attachment that includes a sleeve for use in a spray dispenser device. For example, the attachment can include a decomposition agent deposited onto or into a fabric support matrix. The fabric support matrix can be used as a sleeve for use in a spray dispenser device, e.g., a handheld spray bottle, such as the device described in U.S. patent application Ser. No. 10/934,960 which is hereby incorporated by reference in its entirety. The sleeve can be inserted into the dispenser. The attachment contacts a diluent fluid, e.g., a peroxygen containing composition, present in the bottle. Alkalinity is generated upon contact of the sleeve with the diluent fluid. The alkalinity can then be dispensed from the spray bottle and used in a variety of cleaning applications, e.g., hard surface cleaning. Once the diluent fluid is used up, new fluid can be added. The sleeve can be replaced as often as necessary to generate alkalinity.

Another embodiment of the present invention includes a kit for generating in situ alkalinity containing a cleaning device and instructions for use. The cleaning device comprises a decomposition agent and a support matrix.

Methods of Generating Alkalinity In Situ

In addition to the embodiments of the invention providing a cleaning composition and systems for generating alkalinity, the present invention provides for methods of generating alkalinity in situ. The methods according to the invention provide cleaning composition capable of forming alkalinity at the point of use. The methods according to the invention produce a cleaning agent with a decomposed peroxygen source that generates alkalinity and/or causing bubbling. The increased alkalinity and/or the formation of bubbles provides for improved cleaning, such as improved removal of soil from hard surfaces.

The methods according to the invention comprise contacting the decomposition agent and the peroxygen source to generate alkalinity at a desired time of use. The increased alkalinity can thus be generated in situ at the site of use or at some desired time prior to use, providing for increased safety for those handling and using the cleaning composition.

In some aspects, the methods according to the invention provide for increasing the alkalinity of a reduced alkalinity cleaning agent, such as a peroxy detergent, including providing a cleaning agent, combining the cleaning agent with a peroxygen source to form a peroxygen containing cleaning agent, and contacting the peroxygen containing cleaning agent with a decomposition agent, wherein the decomposition agent facilitates the decomposition of the peroxygen source to generate alkalinity. In some embodiments the step of contacting the peroxygen containing cleaning agent with a decomposition agent occurs at the point of use. In some embodiments, the step of contacting the peroxygen containing cleaning agent with the decomposition agent occurs prior to application of the cleaning composition to a surface to be cleaned.

In some embodiments of the method, the step of contacting the peroxygen containing cleaning agent with a decomposition agent occurs in a washing system. In some embodiments, the decomposition agent is located in a washing system. The washing system in such embodiments may be a ware washing machine, an automatic dishwashing machine, a vehicle washing system, an instrument washer, a clean-in-place system, a food processing cleaning system, floor scrubber, a bottle washer, or a laundry washing machine.

In some embodiments of the method, the decomposition agent is provided in or is located in a cartridge. In some embodiments, contacting the peroxygen containing cleaning agent with the decomposition agent includes passing the peroxygen containing cleaning agent through the cartridge. The decomposition agent may be located in a cartridge within the washing system or connected to the washing system. Alternatively, the decomposition agent may form a component within the washing system, such as within the washing compartment of the washing system. For example, the decomposition agent may form, or may be included as part of or affixed to, a dish rack, a rinse arm, a nozzle, an inside surface or wall, a pumping component, a door latch, or any other component of a washing system or may form a piece that is adhered to the washing system, such as a sheet stuck to the interior of the door or walls. As such, the cleaning agents and peroxygen source could contact the decomposition agent and generate alkalinity during the washing cycle, within the washing system and at the point of use of the cleaning composition. In this way, a worker using the cleaning agent would avoid contacting the final cleaning composition after the alkalinity is raised.

Embodiments of the invention also provide methods of increasing the alkalinity of a cleaning composition. In some embodiments, the cleaning agent and/or peroxygen source has an alkaline pH. In some embodiments, a use solution of the cleaning agent and/or peroxygen source has a pH between about 7 and about 10 prior to peroxygen decomposition. In some embodiments, the cleaning agent has a pH less than 12 when in a use solution in the absence of a peroxygen source and a decomposition agent. In some embodiments, the peroxygen containing cleaning agent has a pH between about 8 and 10. In some embodiments, the decomposition of the peroxygen source increases the pH of the cleaning agent by at least about 1. In some embodiments, the decomposition agent facilitates the decomposition of the peroxygen source to generate alkalinity to increase the pH of the cleaning agent to greater than about 10. In some embodiments, the decomposition of the peroxygen source increases the pH of the cleaning agent to between 10 and 12.

The method according to the invention to increase the alkalinity of a cleaning composition may include providing a cleaning agent and combining the cleaning agent with a peroxygen source to form a peroxygen containing cleaning agent. The step of combining the cleaning agent with a peroxygen source may be performed by the manufacturer of the cleaning agent such that the cleaning agent is supplied to an end user already including the peroxygen source. Alternatively, the cleaning agent may not include a peroxygen source and the peroxygen source may be added to the cleaning agent by a user at the point of use. Alternatively, the cleaning agent may contain the decomposition agent and may not include the peroxygen source. The method further includes contacting the peroxygen containing cleaning agent with a decomposition agent. In other embodiments, the peroxygen source is contacted with the decomposition agent without any cleaning agent to form a cleaning composition. The decomposition agent then catalyzes the decomposition of the peroxygen source to generate alkalinity and/or bubbles.

In some embodiments, a peroxygen source is contacted with a decomposition agent prior to application of the cleaning composition to a surface to be cleaned. For example, in some embodiments, the decomposition agent is located inside of a cartridge. The peroxygen source is contacted with the decomposition agent by passing the peroxygen source through the cartridge. In other embodiments, the decomposition agent may be present within a container into which the peroxygen source is placed, such as a bucket or other receptacle. In such embodiments, alkalinity is generated within the receptacle, and then the cleaning composition having an increased alkalinity is applied to a surface to be cleaned. In some embodiments, the decomposition agent is incorporated into the surface, such as a floor finish for example, to be treated with the peroxygen-containing cleaning composition.

In other embodiments, the peroxygen source is contacted with the decomposition agent at the point of use. For example, embodiments in which the decomposition agent is adhered to or bonded to a fabric or similar material may be useful for point of use generation of alkalinity. In some embodiments, the peroxide source may be contacted with the decomposition agent by applying the peroxygen source to the fabric. For example, the peroxygen source may be applied to the fabric by pouring or spraying it onto the fabric, or by soaking the fabric in the composition. Alternatively, the peroxygen source may be applied to a surface to be cleaned, and then the fabric with the decomposition agent may be brought into contact with the peroxygen source on the surface, catalyzing the creation of alkalinity at the point of use. For example, the peroxygen source may be sprayed onto a surface such as a grease soiled grill. A fabric, such as a sponge, which includes a decomposition agent may then be used to wipe or scrub the surface of the grill while also generating alkalinity at the same time to increase the effectiveness of the cleaning composition.

Methods of Cleaning

In some aspects, the methods of the present invention relate to methods for cleaning including generating a source of alkalinity in situ. It is contemplated that the methods of the invention can be used in a broad variety of industrial, household, health care, vehicle care, and other such applications. Some examples include surface disinfectant, ware cleaning, laundry cleaning, laundry sanitizing, vehicle cleaning, floor cleaning, floor finish stripping, surface cleaning, pre-soaks, clean in place, and a broad variety of other such applications. The cleaning methods according to the invention include contacting the article or surface to be cleaned with a cleaning device and a peroxygen source. The cleaning device once contacted with the peroxygen source generates alkalinity in situ. The cleaning device includes a decomposition agent and support material. Any peroxygen source suitable of decomposition upon contact with the cleaning device can be used in the methods of the present invention. The peroxygen source can be provided as part of a cleaning agent such as a detergent composition. The cleaning agent can be substantially free of a source of alkalinity. In some embodiments, an additional source of alkalinity is also provided during the contacting step. In other embodiments, the peroxygen source is not provided as part of a cleaning agent, and the alkalinity and/or bubbles generated are used to the clean the selected article.

According to the invention, the article to be cleaned can be contacted with the cleaning device and composition including a peroxygen source in any order and combination. In some embodiments, the composition is applied to the cleaning device prior to contacting the surface. For example, the cleaning device can include a sponge with the decomposition agent impregnated therein. The peroxygen source, e.g., hydrogen peroxide, is then applied to the sponge (e.g., poured or sprayed onto the sponge). The article to be cleaned is then contacted with the sponge including the decomposition agent and the peroxygen source, such that any soil on the article is substantially removed.

In other embodiments, the peroxygen source can be applied to the article before the article is contacted with the cleaning device. That is, the peroxygen source is provided to the article. The cleaning device is then applied to the peroxygen source on the article, generating alkalinity on site. The alkalinity generated can be used alone to remove the soil on the article, or an additional source of alkalinity and/or detergent can also be used to aid in removing the soil from the article. The article can also be contacted with the cleaning device prior to the application of the peroxygen source. For example, the cleaning device can include a silver impregnated fabric. The fabric is laid on the article, and the peroxygen source can be applied to the fabric, e.g., sprayed or poured on to the fabric. The fabric is then allowed to remain on the article for an amount of time sufficient to substantially remove the soil on the surface of the article.

Exemplary articles that can be treated, i.e., cleaned, with the methods of the present invention include, but are not limited to motor vehicle exteriors and interiors, textiles, food contacting articles, clean-in-place (CIP) equipment, health care surfaces, architectural surfaces, and hard surfaces. Exemplary motor vehicle exteriors include cars, trucks, trailers, buses, etc. that are commonly washed in commercial vehicle washing facilities. Exemplary textiles include, but are not limited to, those textiles that generally are considered within the term "laundry" and include clothes, towels, sheets, etc. In addition, textiles include curtains. Exemplary food contacting articles include, but are not limited to, dishes, glasses, eating utensils, bowls, cooking articles, food storage articles, etc. Exemplary CIP equipment includes, but is not limited to, pipes, tanks, heat exchangers, valves, distribution circuits, pumps, etc.

Exemplary health care surfaces include, but are not limited to, surfaces of medical or dental devices or instruments. In some embodiments, a cleaning device according to the present invention is used to line a tray that holds medical or dental instruments. A peroxygen source is applied to the tray while the instruments are present on the tray. The alkalinity generated is capable of cleaning the instruments. Exemplary hard surfaces include, but are not limited to, floors, counters, glass, walls, etc. Hard surfaces can also include the inside of dish machines, and laundry machines. In general, hard surfaces can include those surfaces commonly referred to in the cleaning industry as environmental surfaces. Such hard surfaces can be made from a variety of materials including, for example, ceramic, metal, glass, wood or hard plastic.

All publications and patent applications in this specification are indicative of the level of ordinary skill in the art to which this invention pertains. All publications and patent applications are herein incorporated by reference to the same extent as if each individual publication or patent application was specifically and individually indicated by reference.

EXAMPLES

Embodiments of the present invention are further defined in the following non-limiting Examples. It should be understood that these Examples, while indicating certain embodiments of the invention, are given by way of illustration only. From the above discussion and these Examples, one skilled in the art can ascertain the essential characteristics of this invention, and without departing from the spirit and scope thereof, can make various changes and modifications of the embodiments of the invention to adapt it to various usages and conditions. Thus, various modifications of the embodiments of the invention, in addition to those shown and described herein, will be apparent to those skilled in the art from the foregoing description. Such modifications are also intended to fall within the scope of the appended claims.

In the described experiments, pH levels of the solutions were monitored using a laboratory pH meter standardized between a pH of 7 and 10. The initial pH levels of the solutions were adjusted using either sodium hydroxide or ash.

Example 1

Evaluation of Decomposition Agents: Various potential decomposition agents were tested for an increase in pH by hydrogen peroxide decomposition. Aqueous solutions were prepared including 5% hydrogen peroxide having an initial pH of 10, and 100 ppm of various decomposition agents. The pH of the solutions was monitored for 20 minutes at ambient temperature and the results are shown in FIG. 1. Very few materials resulted in a pH increase as they caused the decomposition of hydrogen peroxide. Silver sulfate produced an increase in pH comparable to that obtained with a manganese-containing compound commercially available as "Dragons Blood"/Dragon A350 (manganese) from Rahu Catalytics. Silver sulfate also produced one of the fastest rates of pH increase via hydrogen peroxide decomposition compared to the various potential catalysts evaluated for alkalinity generation.

In addition to monitoring the pH of the solutions, the solutions were also observed for the presence of bubbling. The results on the observations is shown in the table below.

| | no pH increase | pH increase |
|---|---|---|
| no bubbles | Sodium chloride | |
| | magnesium chloride | |
| | magnesium acetate | |
| | magnesium citrate | |
| | magnesium gluconate | |
| | sodium phosphomolybdate | |
| | chloride | |
| | magnesium molybdate | |
| | magnesium gluconate | |
| | sodium molybdate | |
| | copper(II) acetate | |
| | copper(II) sulfate | |
| | copper(II) hydroxide | |
| | copper(II) chloride | |
| | titanium(II) oxide | |
| | zinc acetate | |
| | scandium acetate | |
| | Peractive MOR | |
| | Peractive LAC | |
| | vanadium (II) | |
| bubbles | manganese(II) oxide | Vanadium (II) sulfate |
| | manganese(II) carbonate | Silver (I) sulfate |
| | manganese(II) sulfate | Dragon A350 (Mn IV) |
| | chloride | manganese (II, IV) oxide |
| | manganese(II) acetate | |
| | iron(II) sulfate | |
| | iron(II) oxide | |
| | iron(III) oxide | |
| | iron(III) citrate | |
| | iron(III) gluconate | |
| | sodium hydroxide | |
| | cobalt(III) hydroxide | |
| | vanadium(III) | |
| | sodium molybdate | |
| | Stainless Amine (Fe II) | |
| | silver(I) oxide | |
| | silver(I) zeolite | |
| | silver | |

While many of the tested decomposition agents caused hydrogen peroxide to decompose under alkaline conditions as evidenced by bubbling, very few decomposition agents produced an increase in alkalinity.

The results diverge from the appreciated use of metallic catalysts in the preparation of rocket propellant sources from highly concentrated hydrogen peroxide ($H_2O_2$ often in excess of 70%, 90% and 98%). See e.g., U.S. Pat. Nos. 6,991,772 and 6,887,821. According to the invention a dilute peroxygen source can be decomposed to generated alkalinity in situ from a reduced alkalinity detergent in combination with an alkalinity generating decomposition agent. The results further diverge from use of catalysts to enhance bleaching activity of a detergent, as the decomposition agents are utilized to cause the peroxygen source to actually decompose to generate the alkalinity rather than enhance bleaching of the peroxygen source.

Example 2

Use of Manganese Compounds as Decomposition Agents: An aqueous solution of 5% hydrogen peroxide was adjusted to a pH of 10. The solution was then treated with 100 ppm of Dragon A350 (also referred to as Dragons Blood), a commercially available bleach activator from Rahu Catalytics. According to the invention, Dragon A350 has catalytic activity in the decomposition of peroxy compounds with an accompanying increase in pH.

Figure 2:
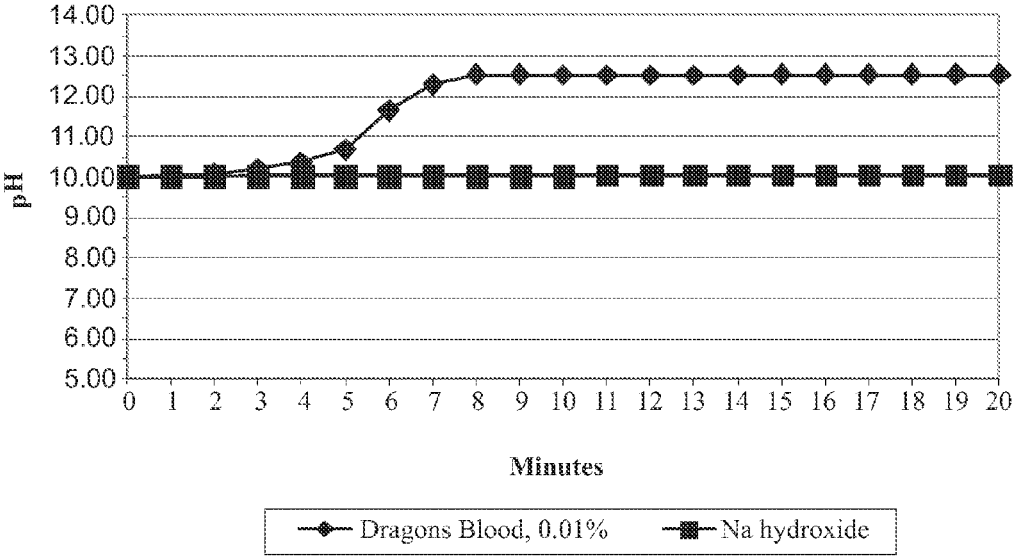
FIG. 2 demonstrates the change in pH over time of peroxygen solutions according to embodiments of the invention.

The pH was monitored over time and the results are shown in FIG. 2. Although Dragon A350 is known to activate bleaching complexes, in the absence of a bleachable substrate as in this experiment, the Dragon A350 decomposed the hydrogen peroxide to form alkalinity. A final pH of over 12 was obtained in about 8-9 minutes at ambient temperature, representing an increase in pH of more than 2. In contrast, alkalinity alone did not lead to hydrogen peroxide decomposition, as shown by the stability of the sodium hydroxide line on FIG. 2.

Example 3

Figure 3:
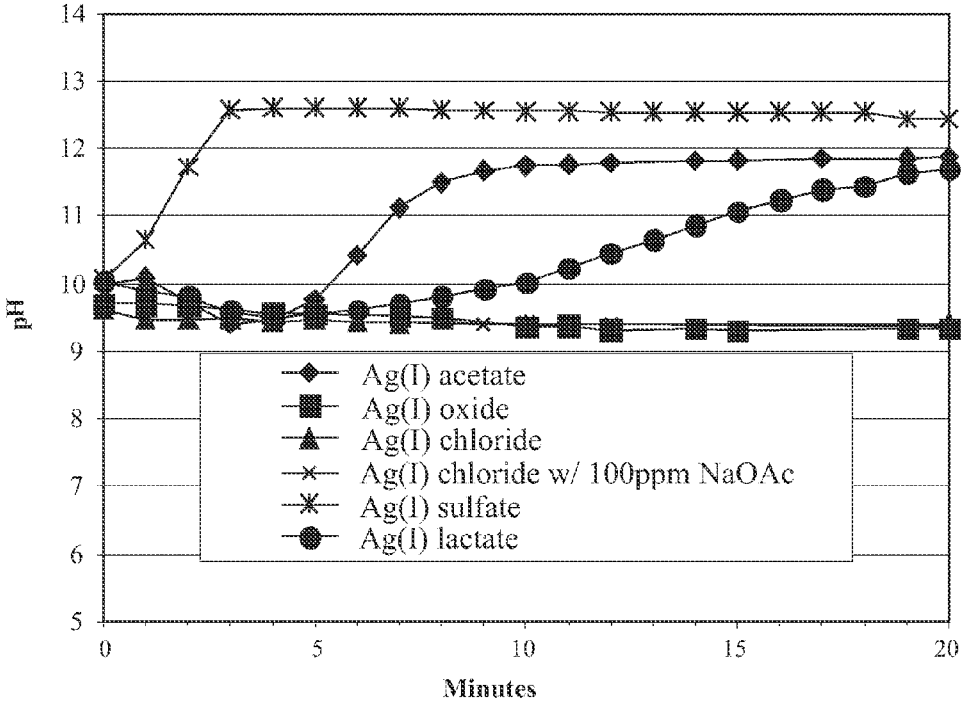
FIG. 3 demonstrates the change in pH over time of peroxygen solutions with various silver decomposition agents according to embodiments of the invention.

Comparison of Silver Compounds as Decomposition Agents: Further evaluation of silver compounds as decomposition agents found that not all silver systems produced a pH increase under the test conditions (100 ppm catalyst, initial pH 10, 5% hydrogen peroxide). Silver sulfate and its carboxylate salts proved to be the most active for increasing pH. It was speculated that adding sodium acetate to the apparently inert silver chloride might result in ion exchange to form the active and more expensive silver acetate. However, no increase in activity over silver chloride alone was noted. An overall trend in silver compound activity appears to be correlated with increasing water solubility of the compounds. FIG. 3 demonstrates silver sulfate and its carboxylate salts produced the greatest increase in pH.

Example 4

Figure 4:
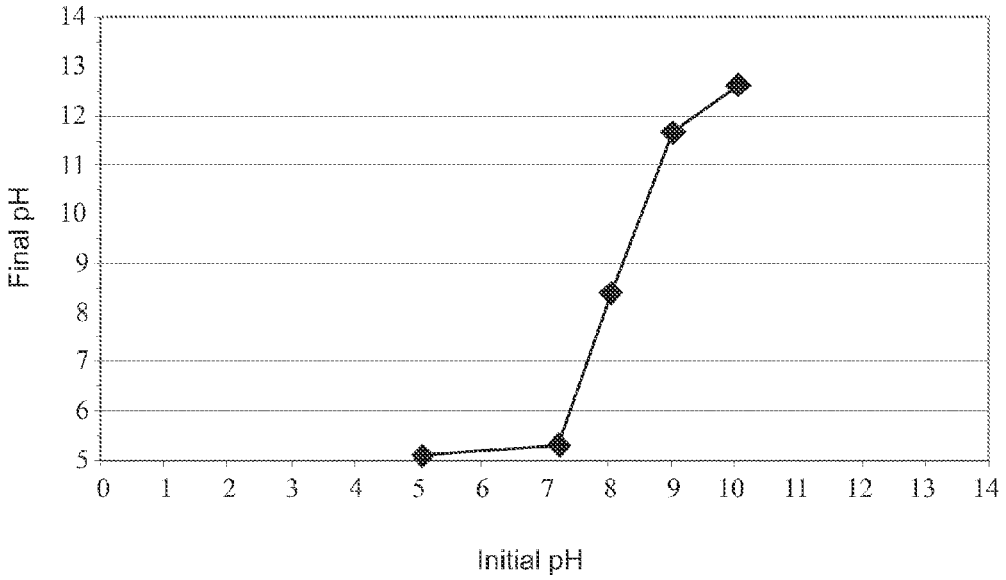
FIG. 4 demonstrates the effect of initial pH on the final pH of peroxygen solutions according to embodiments of the invention.

Effect of Starting pH on pH Increase caused by Decomposition Agent: Aqueous solutions were prepared having 0.1% Dragon A350 and 5% hydrogen peroxide. The solutions also included sodium hydroxide in varying amounts to produce solutions having various pH levels. The pH of the solutions was monitored. The initial pH is charted against the final pH as shown in FIG. 4. When the initial pH was less than 7, there was a decrease in pH. When the initial pH was between 7 and 8, the pH changed from decreasing to increasing. When the initial pH was 8 or more, there was an even greater increase in pH.

Example 5

Effect of Decomposition Agent Concentration on pH Increase: The concentration of decomposition agents was varied to determine its effect on hydrogen peroxide decomposition. Aqueous solutions were prepared having 5% hydrogen peroxide and sodium hydroxide to produce solutions having a pH of 10. Both manganese and silver decomposition agent solutions were tested.

Figure 5A:
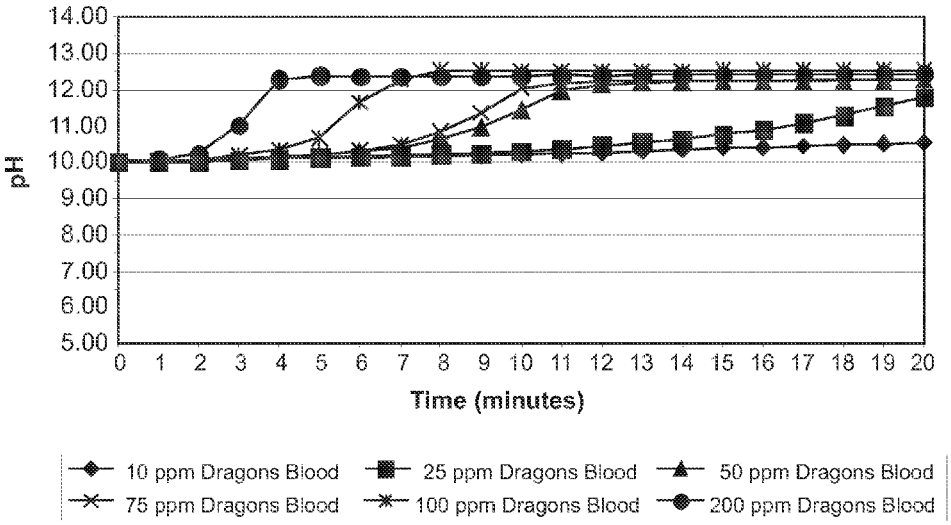
FIGS. 5A-B demonstrate pH over time of solutions including various concentrations of decomposition agents according to the invention.

The first set of solutions included Dragon A350 at concentrations of 10 ppm, 25 ppm, 50 ppm, 75 ppm, 100 ppm and 200 ppm. The pH of each solution was monitored and the results are shown in FIG. 5A. The pH of each solution increased over time, with the higher level of decomposition agent resulting in a faster rate of pH increase.

Figure 5B:
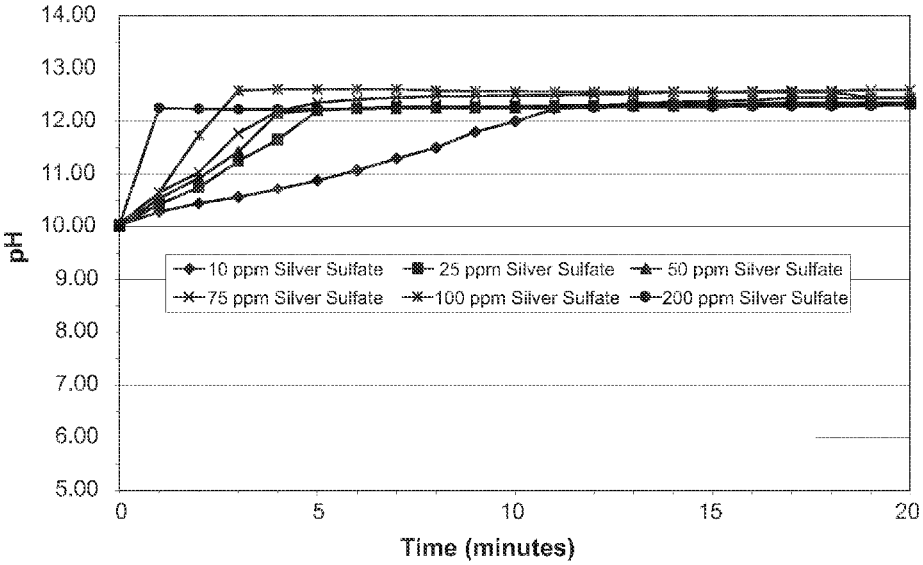

The second set of solutions included silver sulfate as a decomposition agent at concentrations of 10 ppm, 25 ppm, 50 ppm, 75 ppm, 100 ppm, and 200 ppm. The pH of the solutions was monitored for 20 minutes and the results are shown in FIG. 5B. Increasing the concentration of decomposition agent again resulted in a faster rate of pH increase.

Example 6

Figure 6A:
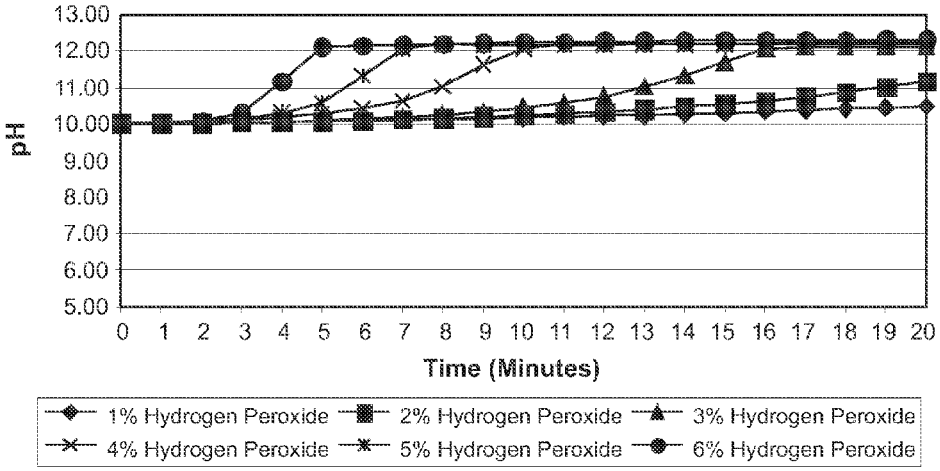
FIGS. 6A-B demonstrate pH over time of solutions containing various concentrations of hydrogen peroxide and a decomposition agent according to embodiments of the invention.

Effect of Peroxygen Source Concentration on pH Increase: The concentration of the hydrogen peroxide (peroxygen source) was varied to determine its effect on hydrogen peroxide decomposition with a decomposition agent. Both manganese and silver decomposition agent solutions were tested. Aqueous solutions were prepared having 100 ppm Dragon A350 and sodium hydroxide to produce solutions having a pH of 10. The solutions included hydrogen peroxide at 1%, 2%, 3%, 4%, 5% and 6%. The pH of each solution was monitored and the results are shown in FIG. 6A. The pH of each solution increased over time, with the higher level of peroxide resulting in a faster rate of pH increase.

Figure 6B:
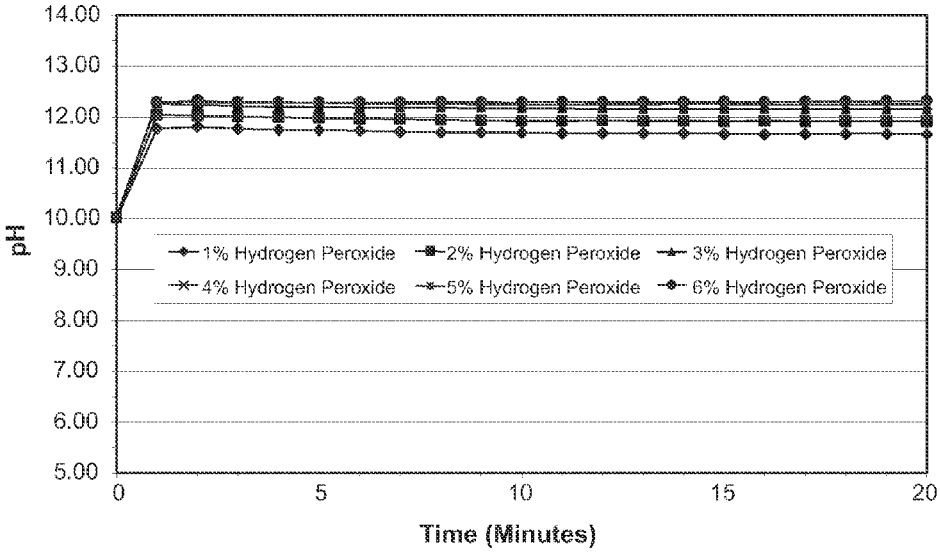

Aqueous solutions were prepared including 100 ppm silver sulfate, sodium hydroxide to produce an initial pH of 10, and hydrogen peroxide at 1%, 2%, 3%, 4%, 5% and 6%. The pH of the solutions was monitored for 20 minutes and the results are shown in FIG. 6B. Higher levels of peroxide again resulted in a faster rate of pH increase.

Example 7

Figure 7A:
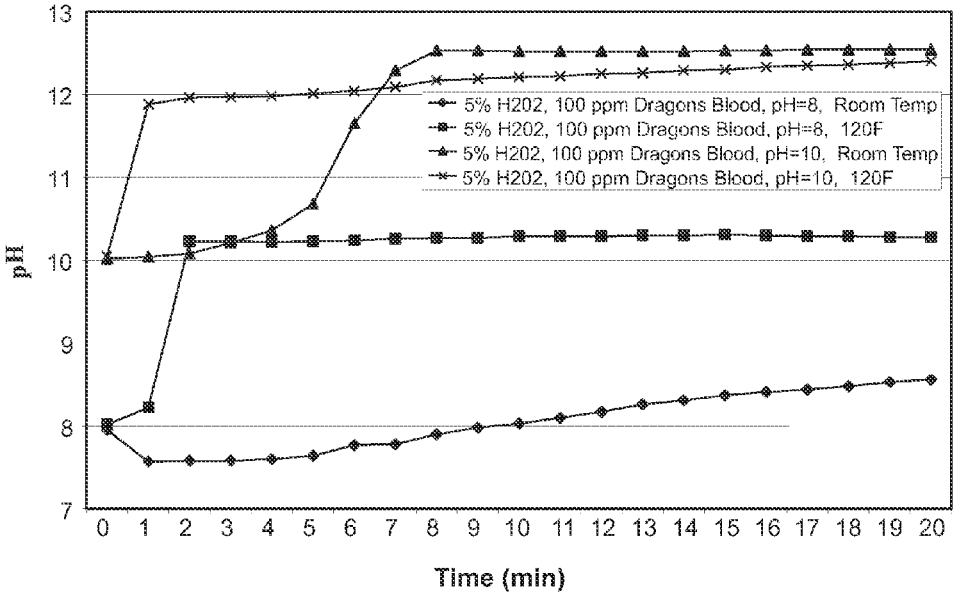
FIGS. 7A-B demonstrates pH over time for solutions including a decomposition agent at different temperatures and initial pH values.
Figure 7B:
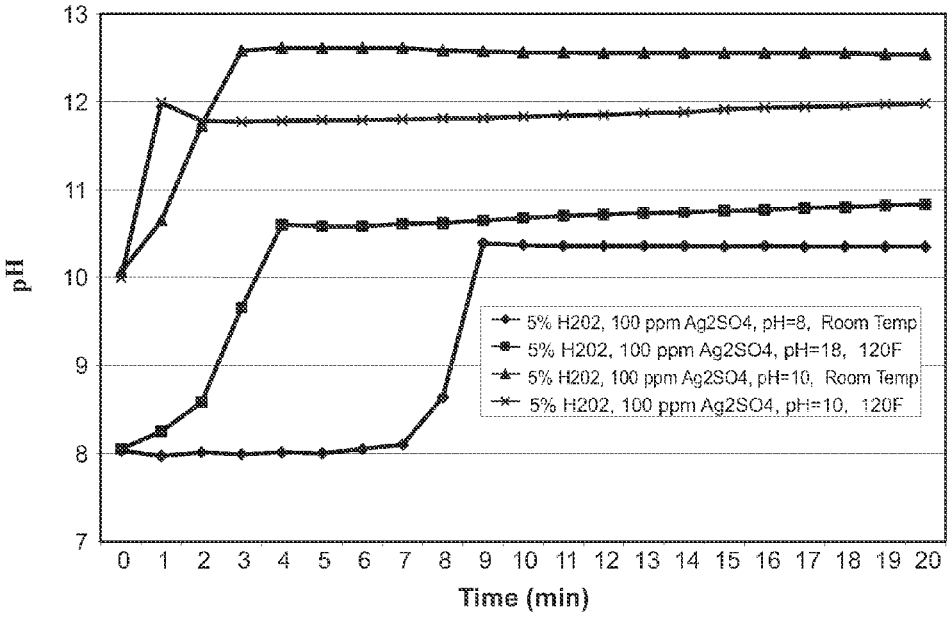

Effect of Temperature on pH Change from Peroxygen Decomposition: Aqueous solutions were prepared having 5% hydrogen peroxide, 100 ppm of either Dragons Blood/Dragon A350 or silver sulfate decomposition agent, and an initial pH of either 8 or 10. The pH of the solutions was monitored for 20 minutes at either room temperature or at 120° F. The results of the solutions containing Dragon A350 are shown in FIG. 7A and the solutions containing silver sulfate are shown in FIG. 7B. Increasing temperature of the solution increased the rate of increasing the alkalinity formation catalyzed by silver sulfate and Dragons Blood at an initial pH of 8 and pH of 10.

Example 8

Figure 8A:
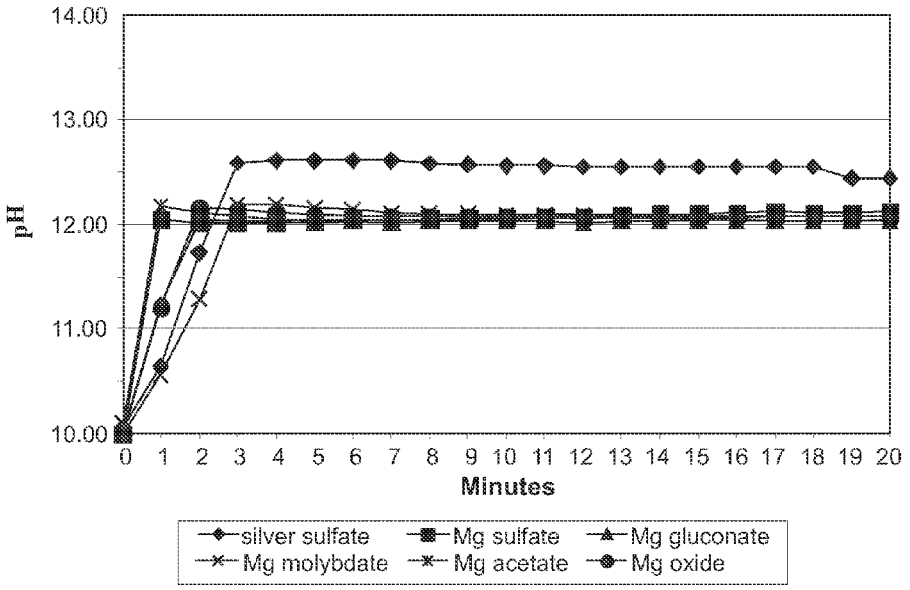
FIGS. 8A-D demonstrate use of promoters with decomposition agents according to embodiments of the invention.

Decomposition Agent Promoters: The effect of potential promoters on a silver sulfate decomposition agent was evaluated. Aqueous solutions were prepared including 100 ppm of the primary decomposition agent (silver sulfate) and 100 ppm of the promoter, 5% hydrogen peroxide, and sodium hydroxide to produce an initial pH of 10. The promoters included magnesium sulfate, magnesium gluconate, magnesium molbdate, magnesium acetate, and magnesium oxide. The pH solutions were monitored for 20 minutes and the results are shown in FIG. 8A. Several magnesium compounds known to stabilize hydrogen peroxide, including magnesium sulfate, magnesium gluconate, magnesium acetate, and magnesium oxide gave a moderate increase in the rate of alkalinity formation, although the equilibrium level of alkalinity was somewhat reduced.

Figure 8B:
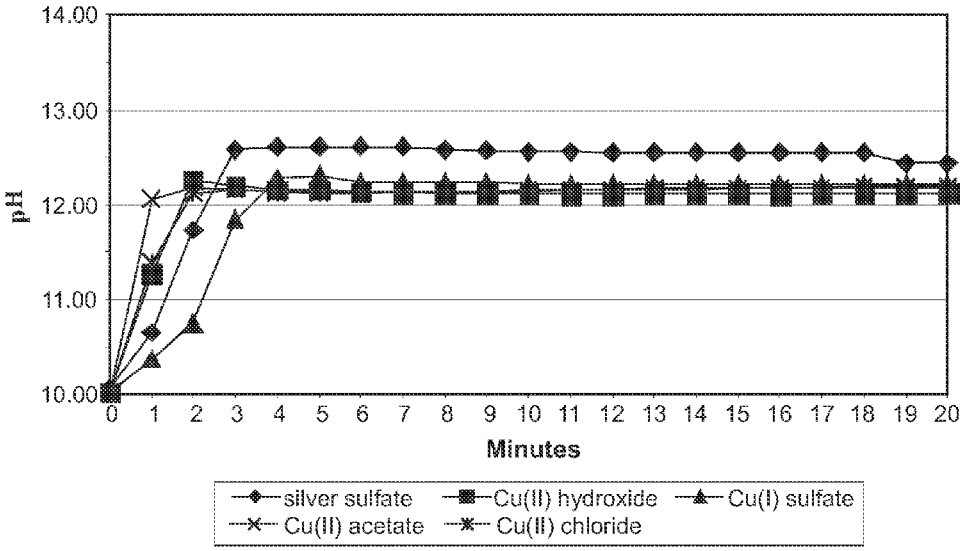

The effect of potential copper promoters on a silver sulfate decomposition agent were further evaluated. Aqueous solutions were prepared including 100 ppm of the primary decomposition agent (silver sulfate), 100 ppm promoter, 5% hydrogen peroxide, and sodium hydroxide to produce an initial pH of 10. The promoters included copper hydroxide, copper sulfate, copper acetate and copper chloride. The pH of the solutions were monitored for 20 minutes and the results are shown in FIG. 8B. Cupric salts gave a moderate increase in the rate of alkalinity formation, although the equilibrium level of alkalinity was reduced. Cuprous sulfate slowed the rate of alkalinity formation.

Figure 8C:
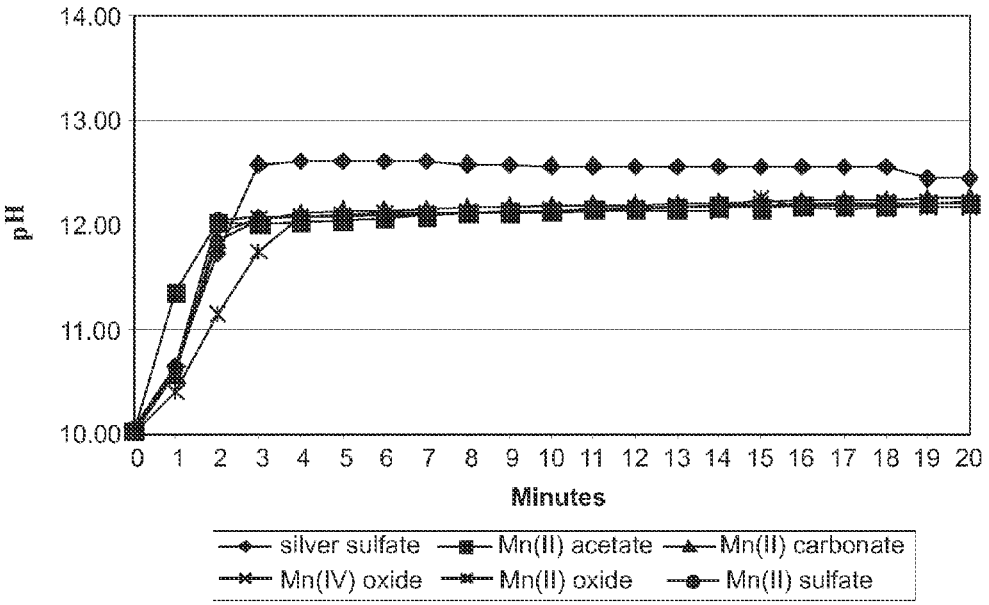

The effect of potential manganese promoters on a silver sulfate decomposition agent were evaluated. Aqueous solutions were prepared including 100 ppm of the primary decomposition agent (silver sulfate), 100 ppm promoter, 5% hydrogen peroxide, and sodium hydroxide to produce an initial pH of 10. The promoters included manganese acetate, manganese carbonate, manganese (IV) oxide, manganese (II) oxide and manganese sulfate. The pH of the solutions was monitored for 20 minutes and the results are shown in FIG. 8C.

Figure 8D:
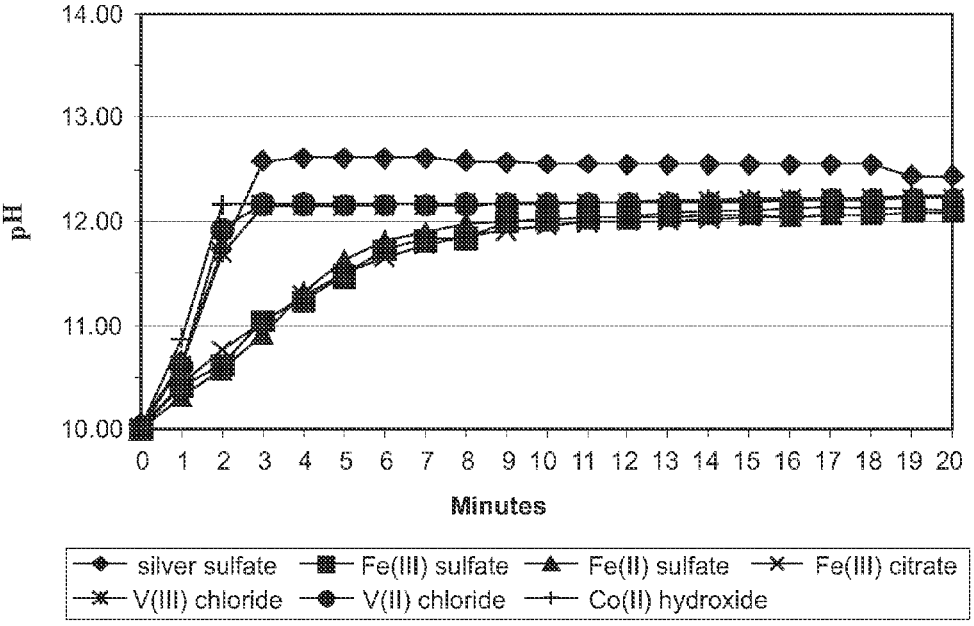

The effect of other potential promoters on a silver sulfate decomposition agent were evaluated. Aqueous solutions were prepared including 100 ppm of the primary decomposition agent (silver sulfate), 100 ppm promoter, 5% hydrogen peroxide, and sodium hydroxide to produce an initial pH of 10. The promoters included iron (III) sulfate, iron (II) sulfate, iron (III) citrate, vanadium (III) chloride, vanadium (II) chloride, and cobalt hydroxide. The pH of the solutions was monitored for 20 minutes and the results are shown in FIG. 8D.

Example 9

Figure 9A:
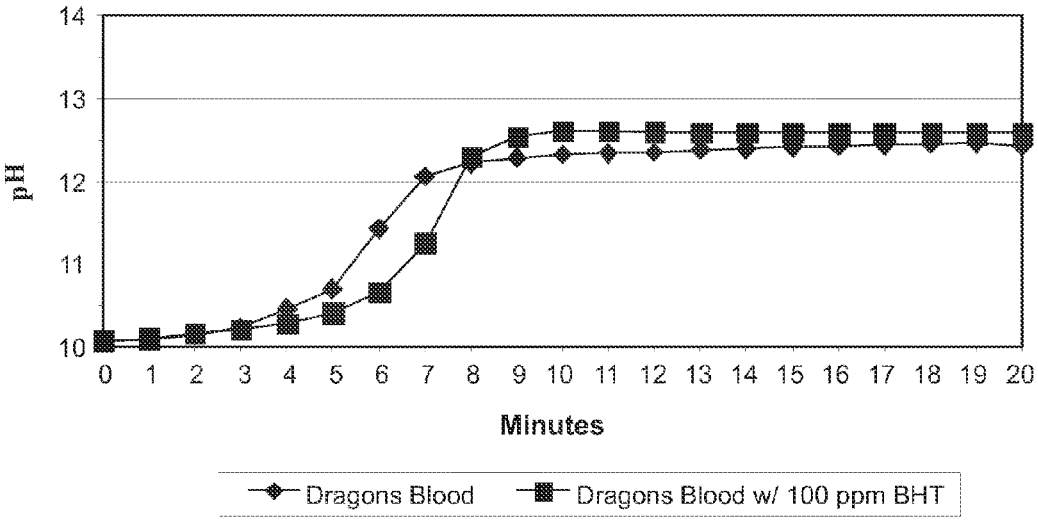
FIGS. 9A-B demonstrate the effect of free radical scavengers on a decomposition agent according to embodiments of the invention.

Effect of Free Radical Scavangers on Rate of pH Increase with Decomposition Agent: Aqueous solutions were prepared including Dragon A350. A free radical inhibitor, BHT (butyl hydroxytoluene) was added to one solution at 100 ppm. As shown in FIG. 9A, the BHT did not significantly alter the rate or the magnitude of the pH increase with Dragon A350.

Figure 9B:
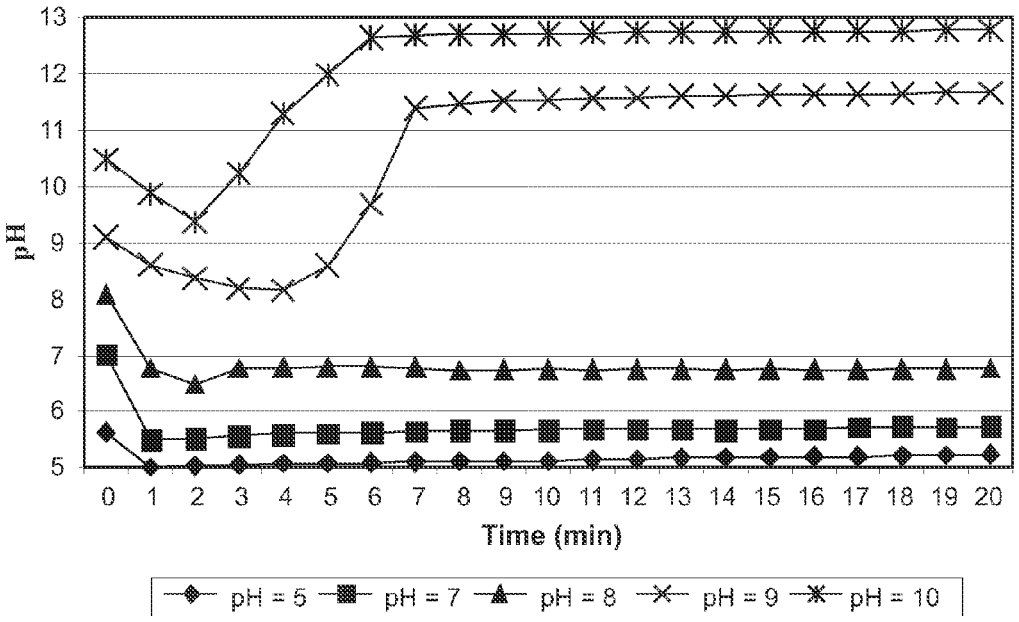

The effect of free radical scavengers were further analyzed at varying initial pH to determine impact on rate of pH increase with decomposition agents. Aqueous solutions were prepared using 100 ppm Dragons Blood, 5% hydrogen peroxide, and 21 ppm ascorbic acid, a free radical scavenger. The initial pH level of the solutions was varied. The solutions were monitored for 20 minutes at ambient temperature. The results are shown in FIG. 9B. The ascorbic acid created an induction period and an initial pH decrease prior to the pH increase.

Figure 10:
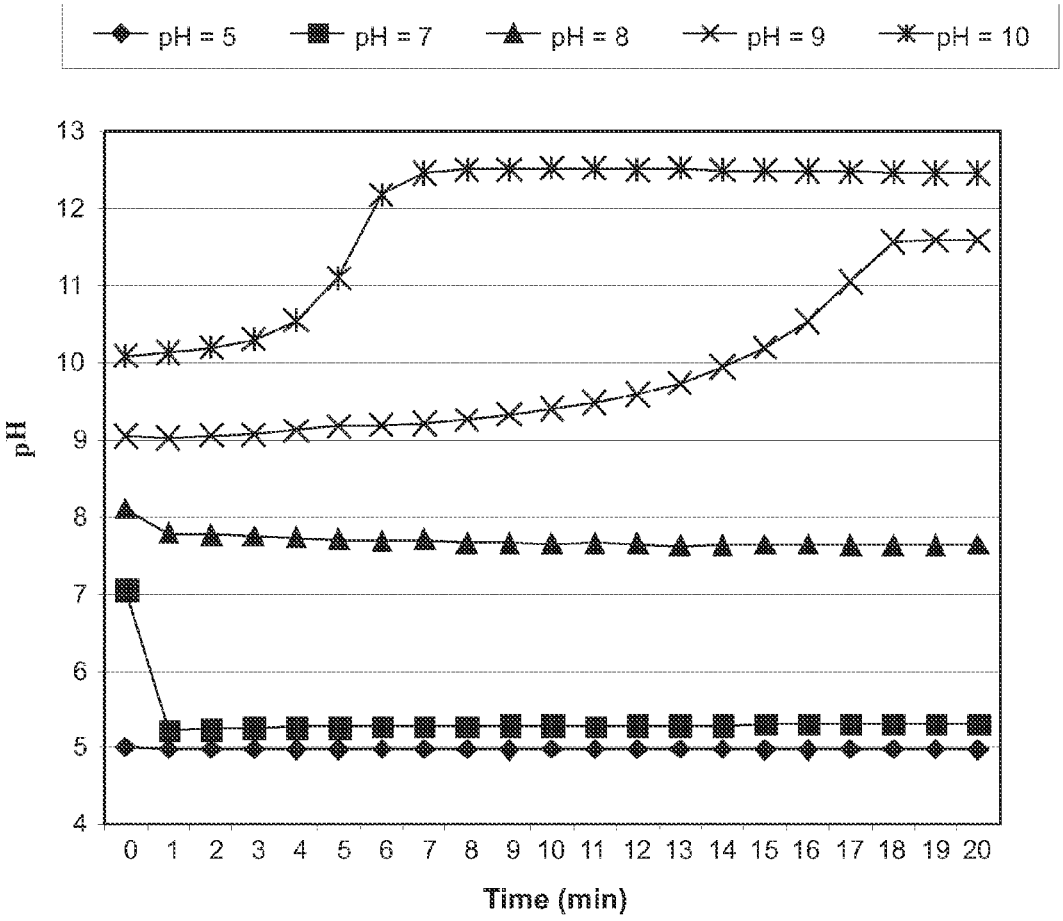
FIG. 10 demonstrate the effect of a chelators on a decomposition agent according to embodiments of the invention.

In addition, the effects of a chelant were analyzed at varying initial pH to determine impact on rate of pH increase with decomposition agents. Aqueous solutions were prepared using 100 ppm Dragon A350, 5% hydrogen peroxide, and 23 ppm gluconic acid, a chelant. The initial pH levels of the solutions were varied. The solutions were monitored for 20 minutes at ambient temperature. The results are shown in FIG. 10. The gluconic acid created a larger induction period than the ascorbic acid, without any initial drop in pH.

Example 10

Figure 11A:
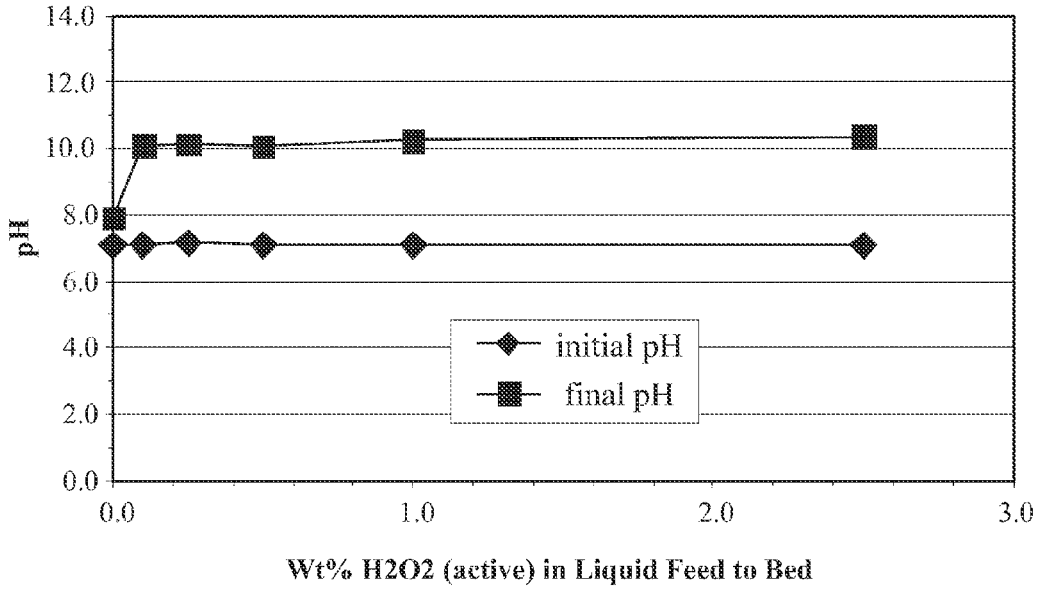
FIGS. 11A-B demonstrate pH of solutions including various concentrations of hydrogen peroxide before and after passing through a gravity fed cartridge with decomposition agent.

Decomposition Agent in Support Medium: A gravity-fed column was prepared having a silver sulfate decomposition agent on a magnesium oxide support as follows. A 200 g bed of 2% silver sulfate powder was physically admixed with 98% granular magnesium oxide and placed in a column. The column was then flushed with a large volume of water until the effluent ran clear. The material remaining in the bed was analyzed and showed the silver sulfate to have stabilized at about 0.2% remaining in the bed with physical loss of the remainder. Solutions having various concentrations of hydrogen peroxide, from 1000 ppm to 2.5% hydrogen peroxide, were then run through the column in 200 mL aliquots. The time required for a gravity feed of 200 mL liquid through the bed was approximately 1 minute. The pH of the solutions was monitored for 20 minutes and the results are shown in FIG. 11A.

Each solution produced a pH of 10-11 from the hydrogen peroxide without any added alkalinity outside of the "captive" alkalinity of the magnesium oxide bed. The effluent from the 1000 ppm peroxide sample was analyzed and showed less than 30 ppm with 200 ppm hydrogen peroxide remaining. It is hypothesized that when the alkalinity and the amount of silver sulfate are greatly increased, the hydrogen peroxide needed to generate a given alkalinity is substantially decreased, improving the system's cost effectiveness.

Samples of the effluent from the 1% hydrogen peroxide solution were placed onto polymerized corn oil and a paper towel was placed onto the effluent. The effluent and paper towel were left to stand for 10 minutes. When the paper towel was removed, the wetted area of the paper towel afforded complete removal of the soil. This result demonstrates the utility of the solution as a potential oven and/or grill cleaner and food processing area cleaner.

Figure 11B:
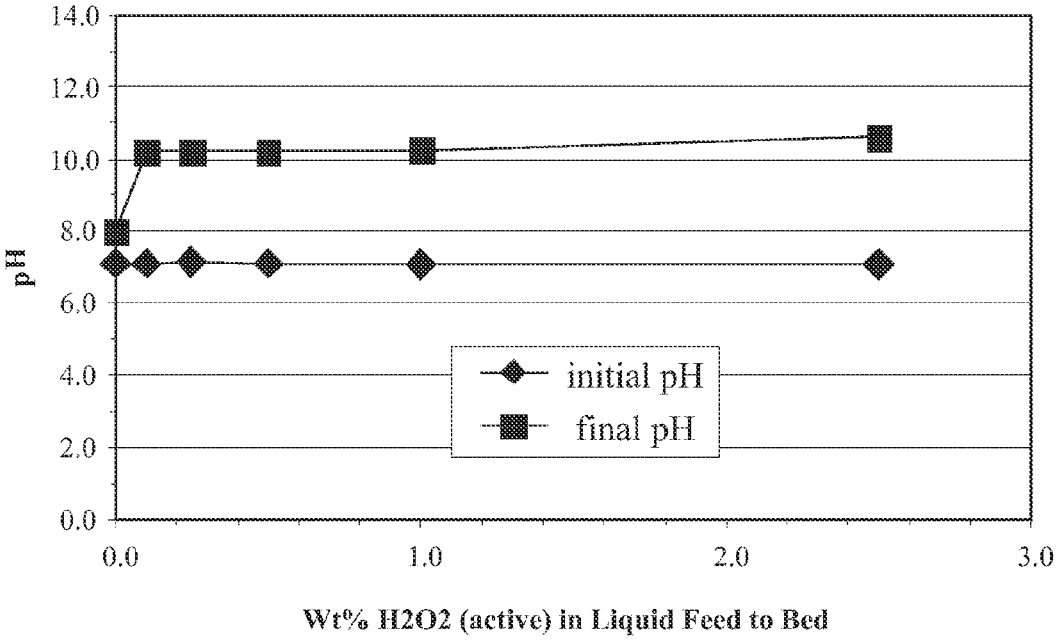

Additional gravity-fed decomposition agent cartridge was prepared using Dragon A350 as follows. A 200 g bed was prepared by adsorbing 2% Dragon A350 onto a 98% granular magnesium bed in a glass column. Magnesium oxide, which has a water solubility of 6 ppm, was selected as the bed based on the promoter study and its ability to have a very mild bulk pH of 8-9 while having a captive localized pH of 12-13 at its surface. The column was then flushed with a large volume of water until the initially orange effluent ran colorless. Various concentrations of hydrogen peroxide were then run through the column in 200 mL aliquots, starting at 1000 ppm hydrogen peroxide and increasing up to a final feed of 2.5% hydrogen peroxide. The time required for the gravity feed of 200 mL liquid through the bed was approximately 1 minute. The initial pH and the final pH of each concentration of hydrogen peroxide are shown in FIG. 11B. Each concentration of hydrogen peroxide consistently gave a pH of 10-11 from the hydrogen peroxide, without any added alkalinity required outside the captive alkalinity of the magnesium oxide bed.

Samples of effluent from the 1% hydrogen peroxide run were placed onto polymerized corn oil and a paper towel was placed onto the effluent. The effluent and paper towel were left to stand for 10 minutes. When the paper towel was removed, the wetted area of the paper towel afforded complete removal of the soil, demonstrating utility as a cleaner such as an oven cleaner, a grill cleaner, or a food processing area cleaner.

Example 11

Decomposition Agent in Fabric Support Medium: A vacuum-operated column having a metallic silver wool decomposition agent was created as follows. A 3 inch long by ½ inch diameter column was packed with 25 g of metallic silver wool. A solution having 5% hydrogen peroxide and a pH of 10 was prepared. A 100 ml aliquot of the solution was poured into the column and drawn through the silver wool by vacuum aspiration. The pH of the liquid exiting the column was measured and had increased to 11.9.

Additionally a commercially-available fabric support media was analyzed. Approximately 25 g of a silver-containing fabric, Medtex P180 OS (available from Statex Productions) was placed into a cartridge. A solution was prepared having 5% hydrogen peroxide and a pH of 10. The solution was run through the cartridge. The pH of the solution exiting the cartridge was 12, demonstrating that the silver-containing fabric catalyzed the decomposition of the hydrogen peroxide with an accompanying formation of alkalinity.

Additionally, a pump-fed column having a silver sulfate/magnesium oxide decomposition agent with percarbonate as a peroxygen source was prepared, as follows. A 12 inch long by 2 inch diameter cartridge was prepared containing a decomposition agent and having a liquid feed inlet, a liquid effluent outlet, and a screen at each end to prevent loss of decomposition agent. The decomposition agent charge consisted of approximately 250 g of 0.2% silver sulfate or 250 g of 0.2% Dragon A350 mixed with 99.8% magnesium oxide. A 5% solution of sodium percarbonate was pumped through the column had an initial pH around 10 and had a final pH on exiting the cartridge of about 12 (using silver sulfate decomposition agent) and about 11 (using Dragon A350 decomposition agent), demonstrating the generation of alkalinity from sodium percarbonate using either a silver or manganese decomposition agent.

Silver-containing fabrics are commercially-available with silver incorporated for antimicrobial preservation and antistatic activity. However, as demonstrated, the use of metallic decomposition agent-containing fabrics combined with peroxygen sources to enhance cleaning are novel uses and benefits.

Example 12

Impregnating a Fabric with a Decomposition Agent and Use as a Cleaning Composition: An ordinary sponge was impregnated with about 0.5 g silver sulfate and about 1 g sodium dodecylbenzene sulfonate by rubbing the silver onto the sponge. A solution of 1% hydrogen peroxide with a pH of 9 was prepared. The solution was poured onto the sponge. Vigorous bubbling occurred with an accompanying generation of foam. The pH of the solution adsorbed by the sponge increased from 9 to about 11. When the bubbling finished, additional hydrogen peroxide was applied and the bubbling resumed, indicating that repeated, multiple uses of the sponge are possible.

Figure 12:
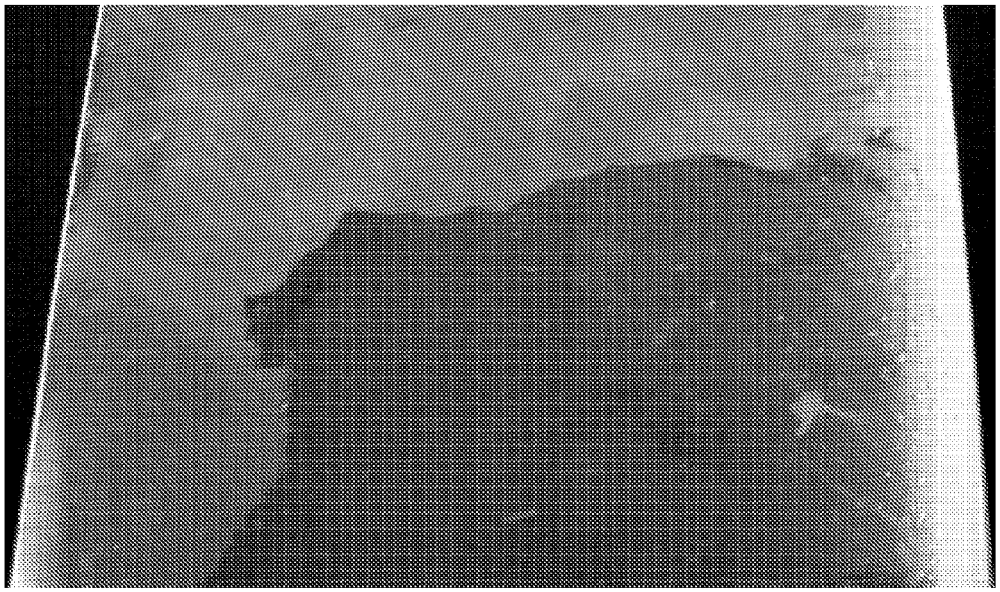
FIGS. 12-13 are photographs showing the removal of polymerized corn oil on a steel surface according to embodiments of the invention.

The sponge was then used to remove polymerized corn oil from a steel surface. The polymerized corn oil was removed with just two swipes of the sponge as shown in FIG. 12, in which the lighter area on the left and top of the photo shows removal of the soil by the sponge. In comparison, when the surface was wiped with a sponge with water at a pH of 9, no soil was removed.

Figure 13:
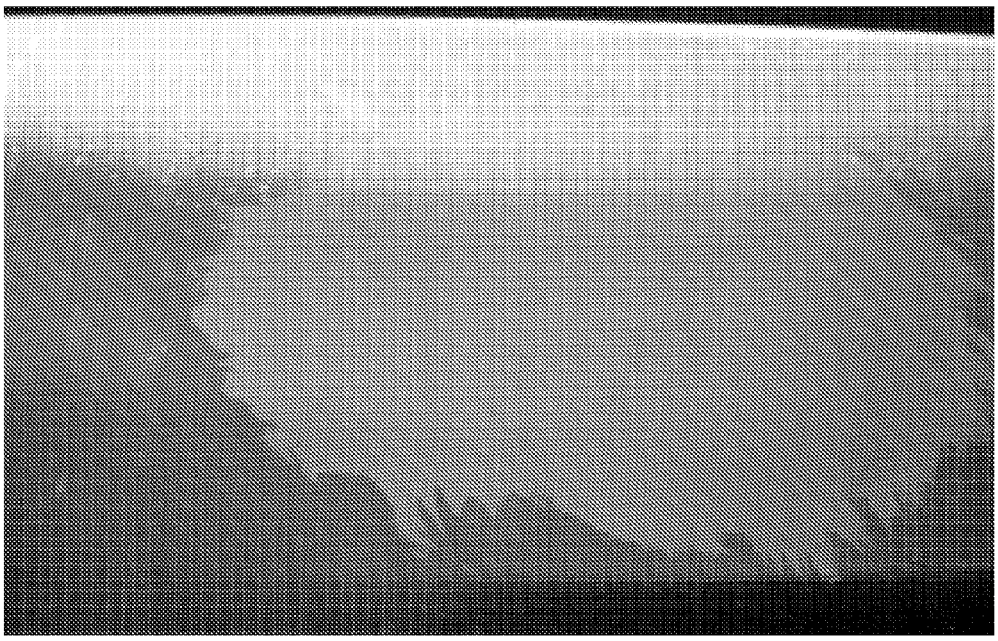

An additional test surface was prepared by polymerizing corn oil onto a steel surface. A piece of silver-containing, nonwoven fabric was placed onto corn oil prepared surface. The silver-containing nonwoven was 97% polyester with 3% of a nylon thread that contained silver. A solution of 1% hydrogen peroxide at pH 9 was prepared and was poured onto the silver fabric. The pH of the solution increased to about 11 after contacting the fabric. The fabric was allowed to sit on the corn oil prepared surface for a few minutes and was then removed. The surface beneath the fabric was clean, as shown in the photograph of FIG. 13. The light area in the center and right portions of the photo show the complete removal of the soil without any wiping or scrubbing.

Example 13

Removal of Polymerized Food Soils: A cleaning solution composition was prepared to test removal of polymerized corn oil from a surface. The cleaning solution composition included 5% hydrogen peroxide catalyzed with either 100 ppm silver sulfate or 100 ppm Dragon A350. The solution had an initial pH of 10 and developed an alkalinity of about 12.5 upon catalysis of the decomposition of the hydrogen peroxide. The solution was applied to polymerized corn oil and allowed to sit for 3 minutes. The soil was completely removed by wiping.

Figure 14A:
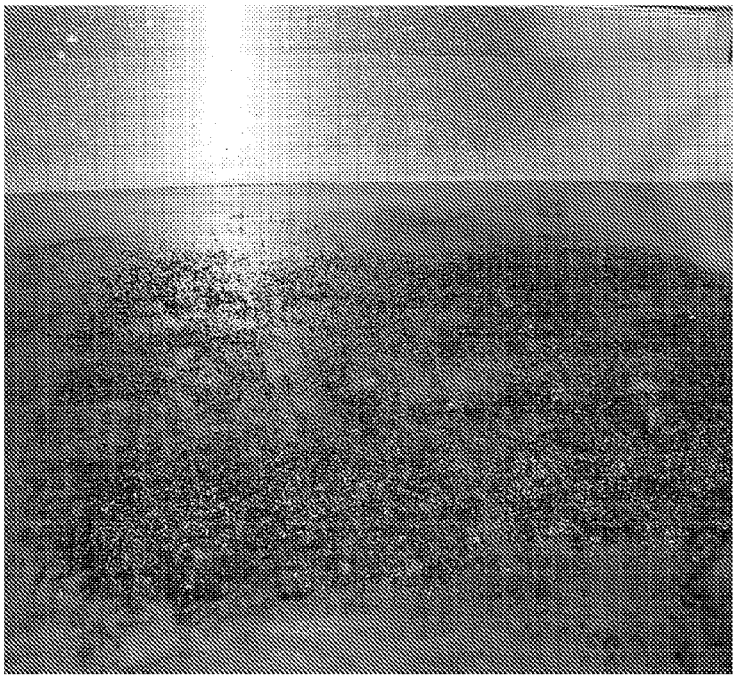
FIGS. 14A-D show photographs of: (A) a soiled commercial grill prior to cleaning; (B) grill with cleaning solutions over which paper towels have been placed; (C) grill after cleaning with a solution of water and a surfactant abraded with a scrub pad; and (D) grill after cleaning with a solution of a silver sulfate decomposition agent and hydrogen peroxide after scrubbing with a paper towel according to embodiments of the invention.

Next, a commercial grill was soiled by cooking a combination of various foodstuffs (hamburger, onion, bacon) on it and then let sit uncleaned for a day to cure. The grill was then soiled again with breakfast soil (eggs, sausage, cheese, hash browns, bacon), quickly scraped, and then followed that up with a lunch soil (chicken, BBQ sauce, onions, tortillas) with no other cleaning. The grill was allowed to cool down enough to touch, to approximately about 120-140° F. The soiled grill prior to cleaning is shown in the photograph in FIG. 14A.

Figure 14B:
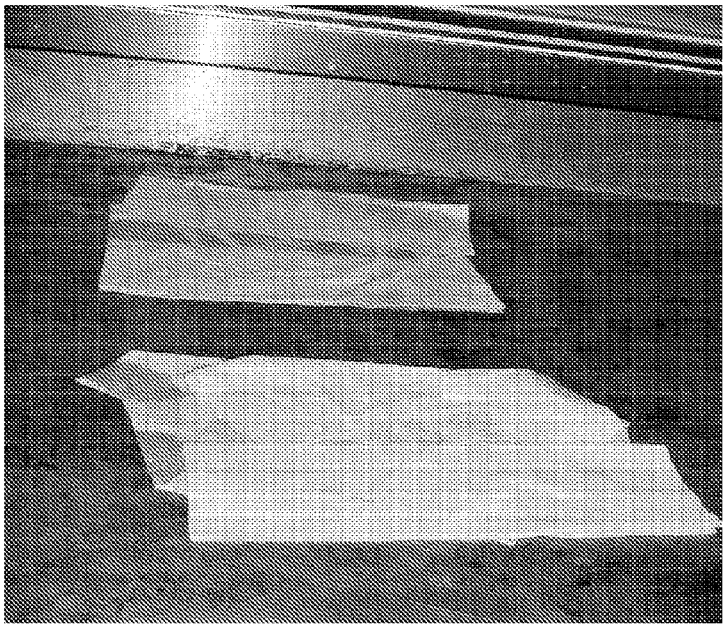

A cleaning solution composition was prepared having 5% hydrogen peroxide, 100 ppm silver sulfate decomposition agent, and Pantastic (manual neutral pH pot and pan detergent commercially available from Ecolab, Inc.). The solution generated a pH of 12.5. The solution was applied to one area or the soiled grill. A second solution was prepared including only Pantastic (with water replacing the hydrogen peroxide). The water/Pantastic solution was applied to a different area of the grill. Both solutions were covered with a paper towel to stop the solutions from running into the grill's drain, as shown in the photograph in FIG. 14B. The paper towel in the back/top of FIG. 14B was placed over the water/Pantastic solution. The paper towel in the front/bottom of FIG. 14B was placed over the peroxide/decomposition agent solution.

Figure 14C:
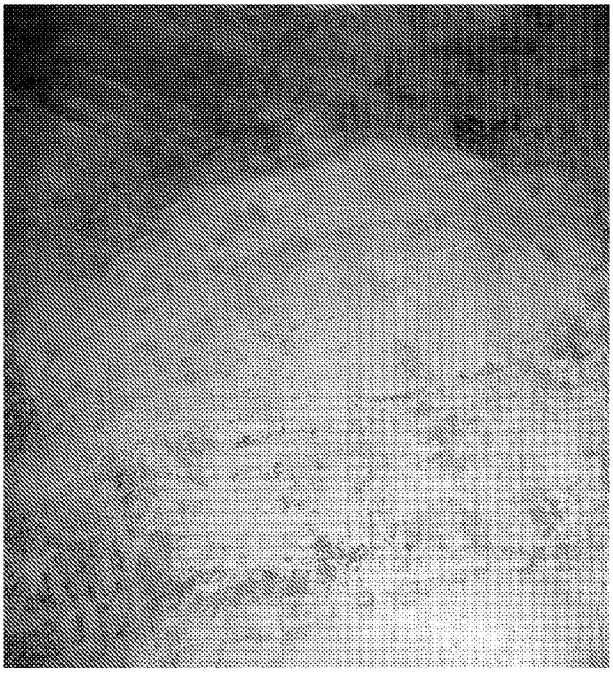
Figure 14D:
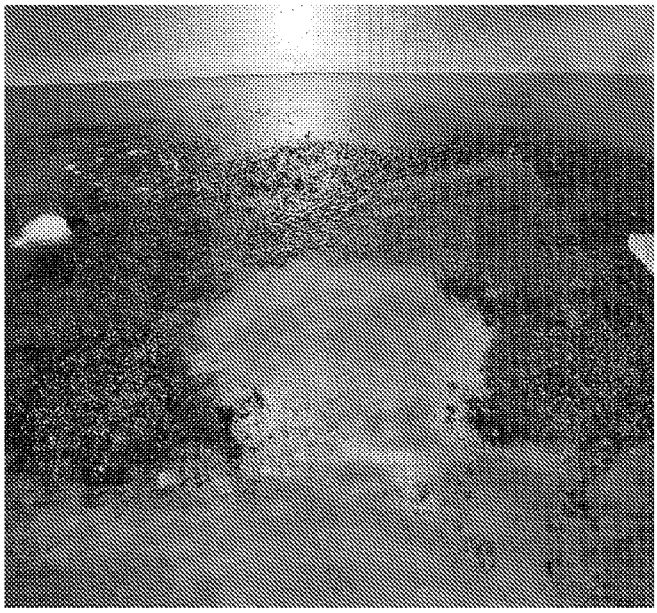

The towel over the peroxide/decomposition agent solution started turning brown from soil pick-up almost immediately, while the towel over water/Pantastic solution demonstrated no change in color, remaining white. The solutions were allowed to sit for 10 minutes and then scrubbed. The water/Pantastic solution area was scrubbed with a paper towel with no soil removed as expected. The same area was then abraded with a green scrub pad, affording only partial removal of soil, as shown in the photograph in FIG. 14C, where the light area is the area of soil removal. The Pantastic plus catalyzed peroxide area was wiped with only a paper towel (not requiring a scrub pad) with complete removal of soil, as shown in the light area of photograph in FIG. 14D.

Example 14

Removal of Floor Finishes: A solution of 5% hydrogen peroxide, 100 ppm silver sulfate, and an initial pH of 10 was prepared. The pH of the solution was monitored and it developed an alkalinity of about pH 12.5. This solution was then applied to a floor tile coated with 5 layers of Laser, a commercial floor finish available from Ecolab. Inc. The solution was left standing for 10 minutes, and the treated area was then scrubbed with a green pad. The floor finish was completely removed. In addition, none of the slipperiness typical of traditional floor finish strippers was noted. The solution therefore provided a highly desirable safety feature for floor stripping.

Additionally, a solution of 5% hydrogen peroxide was prepared with 100 ppm Dragon A350. The solution had an initial pH of 10 and developed an alkalinity of about 12.5. The solution was applied to a floor tile coated with 5 layers of Laser and left standing for 10 minutes and then scrubbed with a green pad. The floor finish was completely removed from the treated area and no was noted.

The inventions being thus described, it will be obvious that the same may be varied in many ways. Such variations are not to be regarded as a departure from the spirit and scope of the inventions and all such modifications are intended to be included within the scope of the following claims.

What is claimed is:

1. A multiple component cleaning system comprising:

a first component comprising a dilute peroxygen source having a concentration from about 0.01-10% and a pH between about 7 and 10;

a second component comprising a decomposition agent, wherein said decomposition agent is silver or manganese; and a third component comprising a support matrix, wherein said decomposition agent is bound to the support matrix;

wherein upon bringing into contact the first component with the bound second and third components a highly alkaline cleaning composition is formed in situ by the decomposition of said first component to form hydroxide anions sufficient to increase the pH of the system by greater than about 3;

wherein said support matrix is a reusable fabric, pad, sponge or combination thereof; and wherein the increase in pH generated does not employ an alkali metal hydroxide or other alkaline compound.

2. The system according to claim 1 having a pH greater than about 10.

3. The system according to claim 1 having a pH greater than about 12.

4. The system according to claim 1 further comprising a fourth component comprising a cleaning agent.

5. The system according to claim 4 wherein said cleaning agent has a pH between about 7 and about 10.

6. The system according to claim 1 further comprising a fifth component comprising a promoter, wherein the promoter increases the rate at which the decomposition agent catalyzes the decomposition of the peroxygen source to form hydroxide anions in order to generate alkalinity.

7. A multiple component cleaning system comprising:

a first component comprising a dilute peroxygen source having a concentration between 0.01-10% and a pH between about 7 and 10;

a second component comprising a decomposition agent wherein said decomposition agent is silver or manganese; and a third component comprising a reusable fabric, wherein said third component is bound to the second component, and wherein upon bringing the first component into contact with the bound second and third components, a cleaning composition is formed through the catalyzation of the decomposition of said peroxygen source to form hydroxide anions sufficient to increase the pH of said peroxygen source by greater than about 3 so that the cleaning composition has a pH greater than about 10, and wherein the increase in pH generated does not employ an alkali metal hydroxide or other alkaline compound.

8. The cleaning system according to claim 7 wherein the cleaning composition has a pH greater than about 12.

9. The cleaning system according to claim 7 wherein said peroxygen source has a concentration from about 0.5-5%.

10. The cleaning system according to claim 8 further comprising a fourth component comprising a cleaning agent.

11. The cleaning system according to claim 10 wherein said cleaning agent has a pH between about 7 and about 10.

12. A cleaning system comprising:

a dilute peroxygen source having a concentration between 0.5-5% and a pH between about 7 and 10;

a cleaning agent having a pH between about 7 and about 10;

a silver or manganese decomposition agent; and a reusable fabric, pad, sponge or combination thereof, wherein said decomposition agent is bound to the fabric, pad, sponge or combination thereof and wherein the combination of the dilute peroxygen source and decomposition agent catalyzes the decomposition of said peroxygen source to form hydroxide anions to generate a highly alkaline cleaning composition, and wherein said decomposition of said peroxygen source is sufficient to generate an increase in pH of greater than about 3 so that the highly alkaline cleaning composition has a pH greater than about 10, and wherein the increase in pH generated does not employ an alkali metal hydroxide or other alkaline compound.

13. The cleaning system according to claim 12 wherein the highly alkaline cleaning composition has a pH greater than about 12.

14. A method for generating alkalinity comprising:

embedding a fabric, pad, sponge or combination thereof with a silver or manganese decomposition agent;

contacting a dilute peroxygen source having a pH between about 7 and 10 with the fabric, pad, sponge or combination thereof; and generating alkalinity via decomposition of said dilute peroxygen source to form hydroxide anions sufficient to increase the pH by greater than about 3, wherein the increase in pH generated does not employ an alkali metal hydroxide or other alkaline compound.

15. The method according to claim 14 wherein alkalinity generated has a pH greater than about 10.

16. The method according to claim 14 wherein alkalinity generated has a pH greater than about 12.

17. The method according to claim 14 wherein said peroxygen source has a concentration from about 0.01-10%.

18. The method according to claim 16 wherein said peroxygen source is hydrogen peroxide having a concentration from about 0.5-5%.

19. The method according to claim 14 wherein said peroxygen source is combined with a cleaning agent.

20. The method according to claim 14 wherein said decomposition agent embedded in said fabric is reusable for continued in situ generation of alkalinity.

21. A method of cleaning comprising:

binding one or more decomposition agents to a support matrix comprising a reusable fabric, pad, sponge or combination thereof;

applying a cleaning composition to an article in need of cleaning, wherein the cleaning composition comprises a dilute peroxygen source having a concentration between about 0.01-10% and a pH between about 7 and 10;

contacting said article with said support matrix, wherein said decomposition agent catalyzes the decomposition of said peroxygen source to form hydroxide anions sufficient to increase pH by greater than about 3 to a pH greater than about 10, and wherein the increase in pH generated does not employ an alkali metal hydroxide or other alkaline compound.

22. The method according to claim 21 wherein said peroxygen source of the cleaning composition has a concentration from about 0.5-5%.

23. The method according to claim 21 wherein said cleaning composition further comprises a reduced alkalinity detergent having a pH between about 7 and about 10.

24. The method according to claim 21 wherein said decomposition agent is a silver or manganese compound.

25. The system according to claim 6, wherein said promoter is selected from the group consisting of: a magnesium ion source; a copper ion source; a zinc ion source; and combinations thereof.

26. The cleaning system according to claim 7, wherein the cleaning composition comprises bubbling useful for improved cleaning.

27. The cleaning system according to claim 12, wherein the cleaning composition is substantially free of iron.

* * * * *